US012392071B2

(12) United States Patent
Choi et al.

(10) Patent No.: US 12,392,071 B2
(45) Date of Patent: Aug. 19, 2025

(54) HOME APPLIANCE SYSTEM, MOBILE APPARATUS AND METHOD FOR CONTROLLING HOME APPLIANCES

(71) Applicant: SAMSUNG ELECTRONICS CO., LTD., Suwon-si (KR)

(72) Inventors: Seungwoo Choi, Suwon-si (KR); Yonghun Choi, Suwon-si (KR); Ahhyun Kim, Suwon-si (KR); Haeyoon Park, Suwon-si (KR); Bobin Kim, Suwon-si (KR); Hansaem Kim, Suwon-si (KR); Juseul Yi, Suwon-si (KR); Joonho Lee, Suwon-si (KR); Jeongwon Hahn, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 254 days.

(21) Appl. No.: 18/080,269

(22) Filed: Dec. 13, 2022

(65) Prior Publication Data

US 2023/0111529 A1 Apr. 13, 2023

Related U.S. Application Data

(63) Continuation of application No. PCT/KR2021/006833, filed on Jun. 2, 2021.

(30) Foreign Application Priority Data

Jun. 18, 2020 (KR) ..... 10-2020-0074108
Mar. 11, 2021 (KR) ..... 10-2021-0032239

(51) Int. Cl.
*D06F 33/72* (2020.01)
*D06F 33/70* (2020.01)
(Continued)

(52) U.S. Cl.
CPC ..... *D06F 33/72* (2020.02); *D06F 33/70* (2020.02); *D06F 34/05* (2020.02); *D06F 2101/14* (2020.02); *D06F 2103/38* (2020.02)

(58) Field of Classification Search
CPC ..... D06F 33/70; D06F 33/72
See application file for complete search history.

(56) References Cited

U.S. PATENT DOCUMENTS 8,543,250 B2 9/2013 Seo et al.
8,868,243 B2 10/2014 Kim et al.
(Continued)

FOREIGN PATENT DOCUMENTS

EP 2 860 296 B1 8/2019
JP 2007-236538 9/2007
(Continued)

OTHER PUBLICATIONS

International Search Report dated Sep. 16, 2021, issued in International Application No. PCT/KR2021/006833.
(Continued)

*Primary Examiner* — Michael E Barr
*Assistant Examiner* — Kevin G Lee
(74) *Attorney, Agent, or Firm* — STAAS & HALSEY LLP

(57) ABSTRACT

A disclosed home appliance system comprises: a washer for washing clothes; a dryer for drying the clothes; an external server for communicating with the washer and the dryer; and a mobile device for controlling the washer and the dryer through the external server, wherein the mobile device can: acquire energy peak time information including time-specific energy billing information from the external server; display a first user interface for receiving the selection of a first interworking course of sequentially operating the washer and the dryer; determine a first cycle time of the first
(Continued)

interworking course including a first washing time of the washer and a first drying time of the dryer, the first cycle time being required in order to perform the first interworking course; display a second user interface for receiving the selection of whether to perform the first interworking course on the basis of the energy peak time information and the first operation time; and transmit first interworking course information to the external server in response to receiving the selection of performing the first interworking course.

15 Claims, 17 Drawing Sheets

(51) Int. Cl.

| | |
|---|---|
| *D06F 34/05* | (2020.01) |
| *D06F 101/14* | (2020.01) |
| *D06F 103/38* | (2020.01) |

(56) References Cited

U.S. PATENT DOCUMENTS

| | | | |
|---|---|---|---|
| 9,303,350 | B2 | 4/2016 | Park et al. |
| 9,442,469 | B2 | 9/2016 | Tsujimura et al. |
| 10,385,495 | B2 | 8/2019 | Heo |
| 2016/0233678 | A1 | 8/2016 | Tuller |
| 2018/0305851 | A1 | 10/2018 | Kwon et al. |
| 2021/0010835 | A1* | 1/2021 | Shang ..... G01D 5/35387 |
| 2021/0062385 | A1 | 3/2021 | Kim et al. |

FOREIGN PATENT DOCUMENTS

| | | | |
|---|---|---|---|
| JP | 2011-160607 | 8/2011 | |
| JP | 2012-95371 | 5/2012 | |
| JP | 6365861 | 8/2018 | |
| JP | 6603064 | 11/2019 | |
| KR | 10-2015-0118429 | 10/2015 | |
| KR | 10-1595391 | 2/2016 | |
| KR | 10-2016-0102704 | 8/2016 | |
| KR | 10-1674955 | 11/2016 | |
| KR | 10-1687034 | 12/2016 | |
| KR | 10-1745889 | 6/2017 | |
| KR | 10-2019-0024671 | 3/2019 | |
| KR | 10-2070783 | 1/2020 | |
| WO | WO-2011162551 A2 * | 12/2011 | ..... D06F 33/00 |
| WO | WO-2011162555 A2 * | 12/2011 | ..... A47L 15/0047 |

OTHER PUBLICATIONS

Written Opinion dated Sep. 16, 2021, issued in International Application No. PCT/KR2021/006833

* cited by examiner

HOME APPLIANCE SYSTEM, MOBILE APPARATUS AND METHOD FOR CONTROLLING HOME APPLIANCES

CROSS-REFERENCE TO RELATED APPLICATIONS

This application is a continuation application, under 35 USC 111(a), of International Application PCT/KR2021/006833, filed Jun. 2, 2021, and claims priority to Korean application 10-2020-0074108, filed Jun. 18, 2020, and Korean application 10-2021-0032239, filed Mar. 11, 2021, the disclosures of which are incorporated herein by reference in their entireties.

BACKGROUND

1. Field

The present disclosure relates to a home appliance system including home appliances used to treat clothes, a mobile apparatus configured to control the home appliances, and a method for controlling the home appliances.

2. Description of Related Art

There are various home appliances used to treat clothes. For example, home appliances for treating clothes include a washing machine that washes clothes, a dryer that dries wet clothes and a clothes care apparatus that deodorizes, sterilizes, removes dust and wrinkles and dries clothes without washing the clothes.

Generally, a user can use home appliances at a desired time for treating clothes. By the way, when a user uses home appliances at an energy peak time, the user spends more on energy cost (for example, electricity cost) rather than other time. A user can directly check and avoid the energy peak time. However, it may be annoying and inconvenient for a user to check the energy peak time and change the usage time every time the home appliance is used. In addition, when a user wants to sequentially use a plurality of home appliances, it may be difficult for the user to avoid the energy peak time in consideration of an operation time for each home appliance.

SUMMARY

One aspect of the present disclosure provides a home appliance system including a washing machine configured to wash clothes, a drying device configured to dry the clothes, an external server configured to communicate with the washing machine and the drying device, and a mobile apparatus configured to control the washing machine and the drying device through the external server. The mobile apparatus is configured to obtain energy peak time information including information about energy price according to the time of the day, from the external server, display a first user interface to receive a selection for a first sequential course sequentially operating the washing machine and the drying device, determine a first operation time of the first sequential course required for performing the first sequential course and including a first washing time of the washing machine and a first drying time of the drying device, display a second user interface to receive a selection of whether to perform the first sequential course based on the energy peak time information and the first operation time, and transmit first sequential course information to the external server in response to receiving the selection for performing the first sequential course.

According to an aspect of the present disclosure, the second user interface may include a button provided to receive an input of a selection for performing the first sequential course while avoiding an energy peak time.

According to an aspect of the present disclosure, the mobile apparatus may be configured to display a third user interface to receive a selection for a second sequential course requiring a second operation time less than the first operation time, based on the energy peak time information.

According to an aspect of the present disclosure, the mobile apparatus may be configured to provide a third user interface to change a performance start time of the first sequential course.

According to an aspect of the present disclosure, the mobile apparatus may be configured to provide a third user interface to set an interval time between completion of operation of the washing machine and start of operation of the drying device, based on the energy peak time information.

Another aspect of the present disclosure provides a mobile apparatus configured to control a washing machine and a drying device through an external server, and including a display, a communication circuitry configured to communicate with the external server, and a controller configured to control the display and the communication circuitry. The controller is configured to obtain electricity rate information including an energy peak time in which a electricity rate is higher than a reference rate, from the external server, provide a first user interface to receive a selection for a first sequential course including a first washing course performed by the washing machine and a first drying course performed by the drying device in accordance with the first washing course, on the display, determine a first operation time of the first sequential course including a first washing time required for performing the first washing course and a first drying time required for performing the first drying course, provide a second user interface to receive a selection of whether to perform the first sequential course based on the energy peak time and the first operation time, and transmit, via the communication circuitry, first sequential course information including first washing course information and first drying course information to the external server in response to receiving the selection for performing the first sequential course through the second user interface.

According to an aspect of the present disclosure, the first operation time may include an interval time between completion of operation of the washing machine and start of operation of the drying device.

According to an aspect of the present disclosure, the controller may be configured to provide a third user interface to receive a selection for performing a second sequential course comprising the first washing course and a second drying course requiring a second drying time less than the first drying time, on the display, and transmit second sequential course information comprising the first washing course information and second drying course information to the external server, in response to receiving the selection for performing the second sequential course through the third user interface.

According to an aspect of the present disclosure, the controller may be configured to provide a third user interface to receive a selection for performing a second sequential course comprising a second washing course requiring a second washing time less than the first washing time and the first drying course, on the display, and transmit second washing course information and the first drying course information to the external server, in response to receiving the selection for performing the second sequential course through the third user interface.

According to an aspect of the present disclosure, the controller may be configured to provide a third user interface to change a performance start time of the first sequential course.

Another aspect of the present disclosure provides a method for controlling a washing machine and a drying device using a mobile apparatus including obtaining energy peak time information from an external server, displaying a first user interface to receive a selection for a first sequential course sequentially operating the washing machine and the drying device by the mobile apparatus, determining a first operation time of the first sequential course required for performing the first sequential course and including a first washing time of the washing machine and a first drying time of the drying device, in response to the selection of the first sequential course through the first user interface, displaying a second user interface to receive a selection of whether to perform the first sequential course based on the energy peak time information and the first operation time, and transmitting first sequential course information to the external server, in response to receiving the selection for performing the first sequential course through the second user interface.

According to an aspect of the present disclosure, the displaying of the second user interface may include displaying a button provided to receive an input of a selection for performing the first sequential course while avoiding an energy peak time.

According to an aspect of the present disclosure, the method may further include displaying a third user interface to receive a selection for performing a second sequential course requiring a second operation time less than the first operation time.

According to an aspect of the present disclosure, the method may further include displaying a third user interface to change a performance start time of the first sequential course.

According to an aspect of the present disclosure, the method may include displaying a third user interface for setting an interval time between completion of operation of the washing machine and start of operation of the drying device, based on the energy peak time information.

Additional aspects will be set forth in part in the description which follows and, in part, will be apparent from the description, or may be learned by practice of the presented embodiments.

DETAILED DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
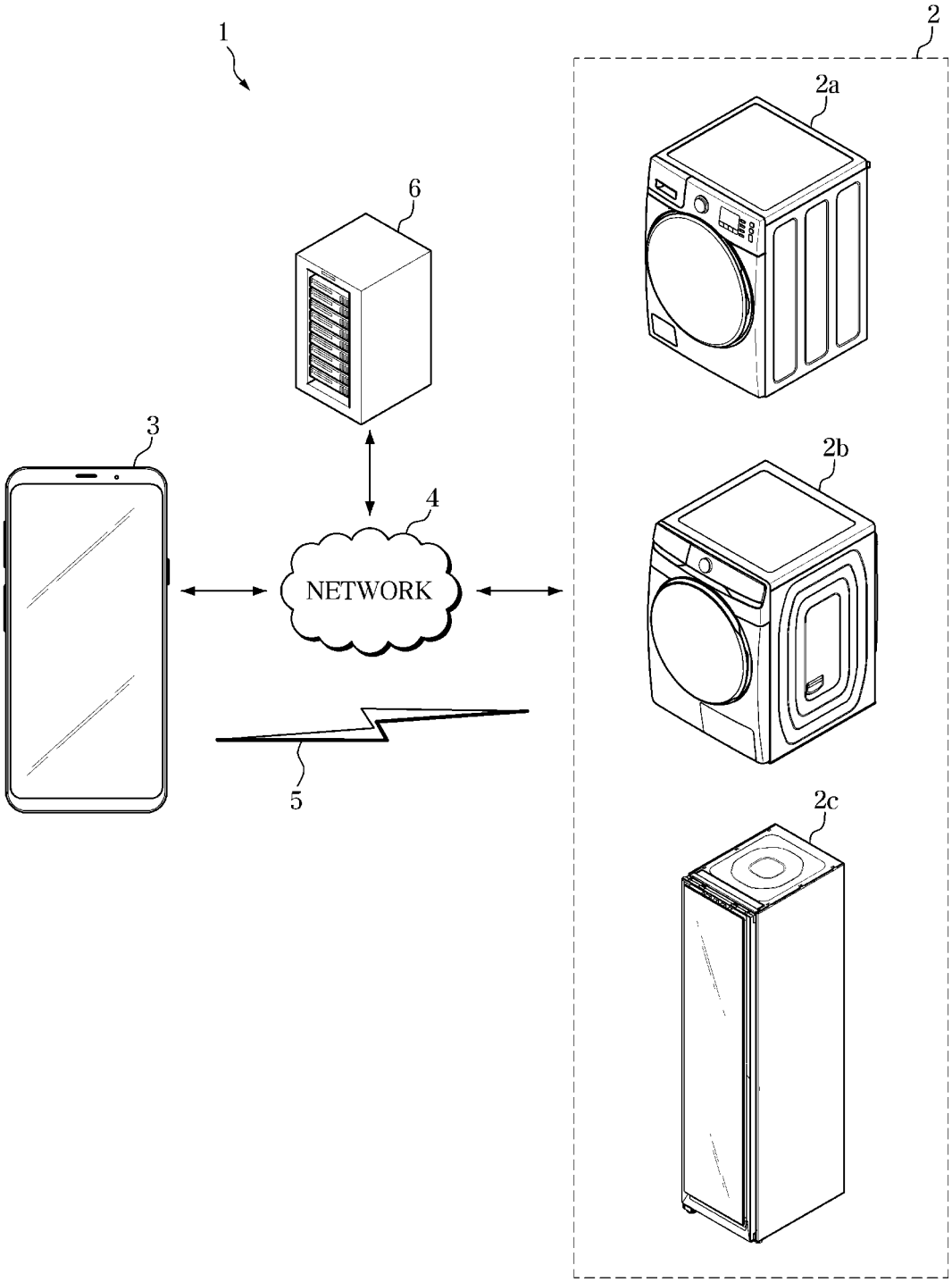
FIG. 1 is a view of a home appliance system according to one embodiment of the present disclosure.

In the following description, like reference numerals refer to like elements throughout the specification. Well-known functions or constructions are not described in detail since they would obscure the one or more exemplar embodiments with unnecessary detail. Terms such as "unit", "module", "member", and "block" may be embodied as hardware or software. According to embodiments, a plurality of "unit", "module", "member", and "block" may be implemented as a single component or a single "unit", "module", "member", and "block" may include a plurality of components.

It will be understood that when an element is referred to as being "connected" another element, it can be directly or indirectly connected to the other element, wherein the indirect connection includes "connection via a wireless communication network", and "electrical connection via an electrical wiring".

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Various embodiment of the present disclosure are directed to providing a home appliance system capable of guiding a user to use home appliances for clothes treatment while avoiding an energy peak time, a mobile apparatus configured to control the home appliances, and a method for controlling the home appliances.

Various embodiments of the present disclosure are directed to providing a home appliance system capable, when sequentially using a plurality of home appliances, of adjusting an operation time of each of home appliances to allow the operation time to avoid an energy peak time, a mobile apparatus configured to control the home appliances, and a method for controlling the home appliances.

According to various embodiments of the present disclosure, a home appliance system, a mobile apparatus configured to control home appliances, and a method for controlling the home appliances, may guide a user to use the home appliance for treating clothes while avoiding an energy peak time. The user can save energy costs by avoiding the energy peak time.

Further, according to various embodiments of the present disclosure, a home appliance system, a mobile apparatus configured to control home appliances, and a method for controlling the home appliances, may, when a plurality of home appliances is to be used sequentially, adjust an operation time of each home appliances to allow the operation time of each home appliances to avoid an energy peak time. For saving energy cost, the operation time of the plurality of home appliances may be automatically adjusted and be guided to a user, thereby improving the user's convenience.

Further, a according to various embodiments of the present disclosure, a home appliance system, a mobile apparatus configured to control home appliances, and a method for controlling the home appliances, may analyze a user's usage pattern for a plurality of home appliances, and recommend a power company suitable for the usage pattern.

FIG. 1 is a view of a home appliance system according to one embodiment of the present disclosure.

Referring to FIG. 1, a home appliance system 1 according to an embodiment may include a home appliance 2 and a mobile apparatus 3. The home appliance 2 may refer to various devices used to treat clothes. For example, the home appliance 2 may include a clothes washer 2*a* configured to wash clothes and a dryer 2*b* configured to dry wet clothes. Further, the home appliance 2 may include a clothes care apparatus 2*c* configured to deodorize, sterilize, remove dust and wrinkles and dry clothes without washing the clothes. The clothes washer 2*a* may be referred to as a washing machine. Because both the dryer 2*b* and the clothes care apparatus 2*c* are configured to perform a drying cycle, the dryer 2*b* and the clothes care apparatus 2*c* may be referred to as a drying device.

The washing machine 2*a* may be operated based on a washing course selected via the mobile apparatus 3, and the drying device 2*b* or 2*c* may be operated based on a drying course selected via the mobile apparatus 3. For example, the washing course may be selected as a standard washing, a strong washing, a soak washing, a quick washing or an eco-washing, and a different washing time may be set for each washing course. A drying course may be selected as a standard drying, a strong drying, a weak drying, a delicate drying, a quick drying or an eco-drying, and a different drying time may be set for each drying course. The washing course and the drying course may be provided in various ways.

The washing machine 2*a* and the drying device 2*b* or 2*c* may be sequentially used. For example, a sequential course may be provided such that the operation of the dryer 2*b* starts after the operation of the clothes washer 2*a* is finished. In addition, a sequential course may be provided such that the operation of the clothes care apparatus 2*c* starts after the operation of the clothes washer 2*a* is finished.

The mobile apparatus 3 may include a portable communication device (for example, a smart phone), a computer device, a portable multimedia device, or a wearable device.

The home appliance 2 and the mobile apparatus 3 may communicate with each other through a first network 4 (for example, a long-range wireless communication network), or through a second network 5 (for example, a short-range wireless communication network). In addition, the home appliance 2 and the mobile apparatus 3 may communicate with an external server 6 through the first network 4. Each of the clothes washer 2*a*, the dryer 2*b* and the clothes care apparatus 2*c* exemplified by the home appliance 2 may be connected to the mobile apparatus 3 through the first network 4 or the second network 5.

The mobile apparatus 3 may obtain a user input and transmit a control signal corresponding to the user input to the home appliances 2 through the external server 6. The home appliances 2 may receive the control signal transmitted from the mobile apparatus 3 through the external server 6, and perform an operation corresponding to the control signal.

The mobile apparatus 3 may include an application for controlling the home appliances 2. The mobile apparatus 3 may transmit a control signal to the home appliances 2 through the external server 6 based on a user input obtained after executing the application. In addition, the mobile apparatus 3 may display a user interface (UI) allowing the home appliance 2 to be controlled. The user interface may include a graphic user interface (GUI). A user can operate the home appliance 2 using the mobile apparatus 3.

The mobile apparatus 3 may communicate with the external server 6. For example, the mobile apparatus 3 may obtain energy cost information including an energy peak time, from the external server 6. The energy cost information may include information on cost per hour and information on energy consumption per hour. An energy rate (electricity rate) corresponding to an energy peak time may be significantly more expensive than energy rates corresponding to other times. The energy peak time may be distinguished from an off-peak time. The off-peak time refers to a time that is not an energy peak time.

Figure 2:
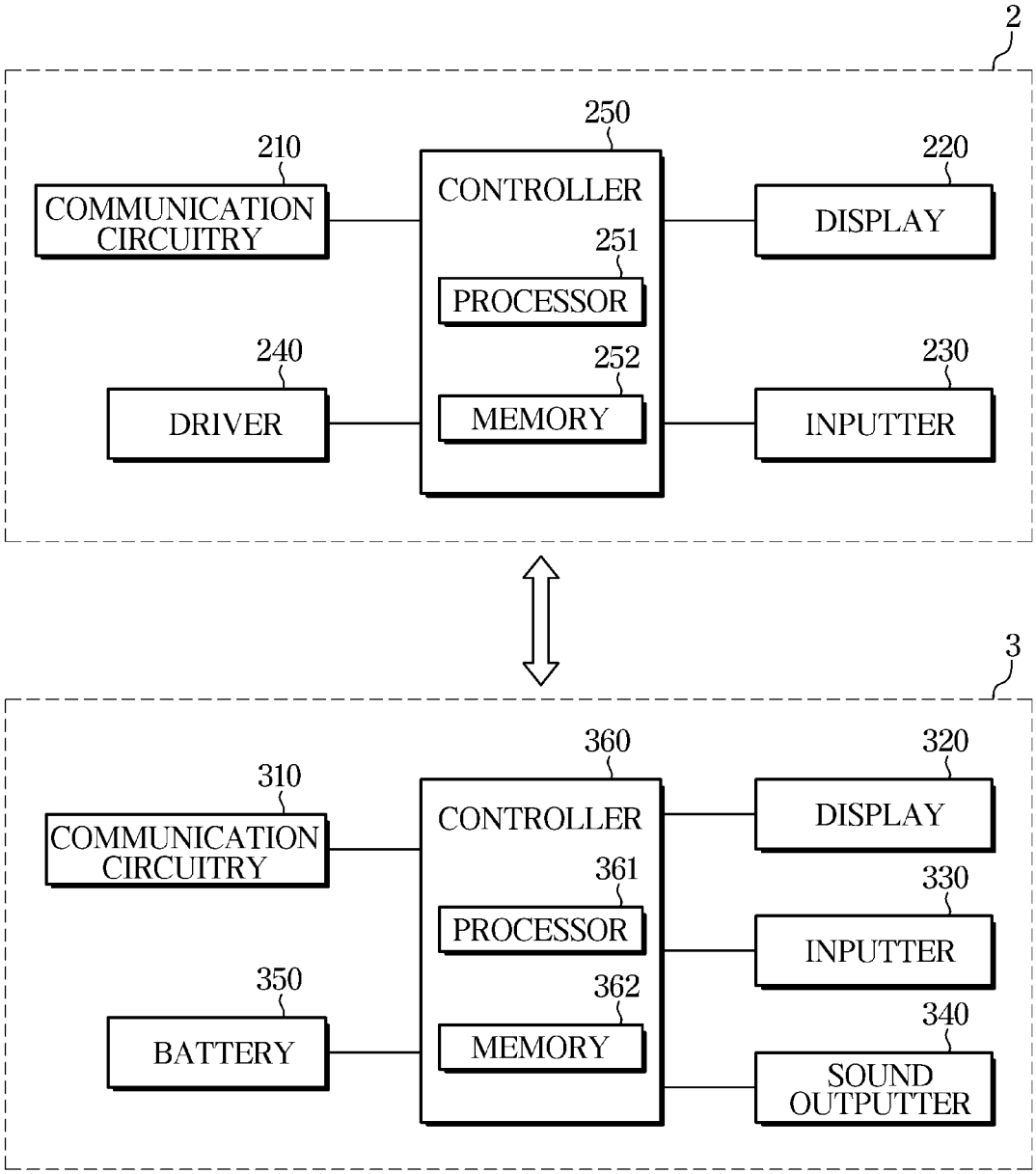
FIG. 2 is a control block diagram of the home appliance system according to one embodiment of the present disclosure.

FIG. 2 is a control block diagram of the home appliance system according to one embodiment of the present disclosure.

Referring to FIG. 2, the home appliance 2 may include a communication circuitry 210, a display 220, an inputter 230, a driver 240, and a controller 250. The controller 250 may be electrically connected to components of the home appliance 2, and control each component of the home appliance 2. In addition, although not shown, the home appliance 2 may include a power supply circuit configured to receive power from an outside.

The communication circuitry 210 may support establishment of a communication channel or a wireless communication channel with the mobile apparatus 3 or the external server 6 and perform the communication through the established communication channel. The communication circuitry 210 may operate independently of a processor 251 of the controller 250 and may include one or more communication processors configured to support the wired communication or the wireless communication. The communication circuitry 210 may be implemented using various communication technologies. For example, the communication circuitry 210 may include a wireless communication module and/or a wired communication module. The wireless communication module may support wireless local area network (LAN), Home Radio Frequency (RF), infrared communication, Ultra-wide band (UWB) communication, Wi-Fi, Wi-Fi Direct, Bluetooth, AD-HOC and/or Zigbee. The communication circuitry 210 of the home appliance 2 may be referred to as "first communication circuitry".

The display 220 may display information related to the operation of the home appliance 2. The display 220 may display information input by a user or information provided to the user, on various screens. The display 220 may display information related to the operation of the home appliance 2 as at least one of an image or text. The display 220 may display a graphic user interface (GUI) allowing the home appliance 2 to be controlled. For example, the display 220 may display a User Interface (UI) Element such as an icon.

In the home appliance 2, the display 220 may be provided in various forms at various locations according to a design thereof. The display 220 may include various types of display panels. For example, the display 220 may include a liquid crystal display (LCD) Panel, a light emitting diode (LED) panel, an organic light emitting diode (OLED) panel or a micro-LED panel. The display 220 may also be used as an input device by including a touch screen.

The inputter 230 may obtain a user input. The user input may correspond to various commands related to the operation of the home appliance 2. For example, the user input may correspond to a power-on command, a power-off command, an operation mode selection command, an operation start command or an operation stop command. The inputter 230 may be provided in various forms at various locations according to the design of the home appliance 2. For example, the inputter 230 may include at least one of a dial, a control wheel, a touchpad, a physical button or a touch button.

The driver 240 may represent a configuration that directly performs the operation of the home appliance 2. For example, in the clothes washer 2*a*, the driver 240 may include a motor configured to rotate a drum, a power transmission device configured to transmit power of the motor to the drum, an inverter configured to supply power to the motor, a heater configured to heat water supplied into the drum, a water supply device configured to supply water into the drum, and a drainage device configured to discharge the water in the drum to an outside. As the driver 240 of the clothes washer 2*a* operates, a washing operation of clothes may be performed.

In the dryer 2*b*, the driver 240 may include a motor configured to rotate a drum and a fan, a power transmission device configured to transmit power of the motor to the drum, the fan configured to move air into the drum, and a heater and a heat pump configured to heat air supplied into the drum. As the driver 240 of the dryer 2*b* operates, a drying operation of the clothes may be performed.

In the clothes care apparatus 2*c*, the driver 240 may include a fan configured to move air into a chamber in which clothes are mounted, a motor configured to rotate a fan, and a heat pump configured to heat air supplied into the chamber. The driver 240 of the clothes care apparatus 2*c* may further include a steam generator for supplying steam into the chamber, a deodorization device and a sterilization device. As the driver 240 of the clothes care apparatus 2*c* operates, a clothes care operation may be performed.

The controller 250 may include the processor 251 and a memory 252. The memory 252 may store programs, instructions, and data for controlling the operation of the home appliance 2. The processor 251 may generate a control signal for controlling the operation of the home appliance 2 based on the programs, instructions and data stored and/or stored in the memory 252. The controller 250 may be implemented as a control circuit to which the processor 251 and the memory 252 are mounted. In addition, the controller 250 may include a plurality of processors and a plurality of memories. The controller 250 of the home appliance 2 may be referred to as "first controller".

The processor 251 corresponding to a hardware may include a logic circuit and an arithmetic circuit. The processor 251 may process data according to a program and/or instructions provided from the memory 252, and generate a control signal according to the processing result. The memory 252 may include a volatile memory, such as a static random access memory (SRAM) or a dynamic random access memory (DRAM), for temporarily storing data, and a nonvolatile memory, such as read only memory (ROM), erasable programmable read only memory (EPROM) or electrically erasable programmable read only memory (EEPROM), for storing data for a long period of time.

Some of the above-described components may be removed in the home appliance 2. In addition, the home appliance 2 may further include other components in addition to the above-described components. For example, the home appliance 2 may further include a speaker.

The mobile apparatus 3 may include a communication circuitry 310, a display 320, an inputter 330, a sound outputter 340, a battery 350, and a controller 360. The controller 360 may be electrically connected to components of the mobile apparatus 3, and control each component of the mobile apparatus 3. The controller 360 may generate a control signal for controlling the mobile apparatus 3. In addition, the controller 360 may execute an application for controlling the home appliance 2, and generate a control signal of the home appliance 2. Although not shown, the mobile apparatus 3 may include a power circuit configured to receive power from the outside.

The communication circuitry 310 of the mobile apparatus 3 may support establishment of a communication channel or a wireless communication channel with the home appliance 2 or the external server 6 and perform the communication through the established communication channel. The communication circuitry 310 may operate independently of a processor 361 of the controller 360 and may include one or more communication processors configured to support the wired communication or the wireless communication. The communication circuitry 310 may be implemented using various communication technologies. For example, the communication circuitry 310 may include a wireless communication module and/or a wired communication module. The wireless communication module may support wireless local area network (LAN), Home Radio Frequency (RF), infrared communication, Ultra-wide band (UWB) communication, Wi-Fi, Wi-Fi Direct, Bluetooth, AD-HOC and/or Zigbee. The communication circuitry 310 of the mobile apparatus 3 may be referred to as "second communication circuitry".

The display 320 of the mobile apparatus 3 may display information related to the operation of the mobile apparatus 3. In addition, the display 320 may also be used as an input device including a touch screen. For example, a user's touch may be input on the display 320. The user's touch input may correspond to various commands related to the operation of the mobile apparatus 3. In addition, a user's touch input to the display 320 of the mobile apparatus 3 may correspond to a command related to the operation of the home appliance 2.

The display 320 may display a graphic user interface (GUI) configured to allow the mobile apparatus 3 to be controlled. For example, the display 320 may display a user interface (UI) element such as an icon.

The display 320 may be provided in various forms at various locations according to a design thereof. The display 320 may include various types of display panels. For example, the display 320 may include a liquid crystal display (LCD) Panel, a light emitting diode (LED) panel, an organic light emitting diode (OLED) panel or a micro-LED panel.

The inputter 330 may be provided separately from the display 320 and may obtain a user input. The inputter 330 may be provided in various forms at various locations according to the design of the mobile apparatus 3. For example, the inputter 330 may include at least one of a dial, a control wheel, a fingerprint identification pad, a physical button or a touch button.

The sound outputter 340 may output a sound signal to the outside of the mobile apparatus 3. For example, the sound outputter 340 may include a speaker or a receiver. The speaker may be used for general purposes such as multimedia playback or recording playback. The receiver may be used to receive incoming calls.

The battery 350 may supply power to at least one component of the mobile apparatus 3. According to an embodiment, the battery 350 may include a rechargeable secondary cell or a fuel cell.

The controller 360 may include the processor 361 and a memory 362. The memory 362 may store programs, instructions, and data for controlling the operation of the mobile apparatus 3. The processor 361 may generate a control signal for controlling the operation of the mobile apparatus 3 based on the programs, instructions and data stored and/or stored in the memory 362. The controller 360 may be implemented as a control circuit to which the processor 361 and the memory 362 are mounted. In addition, the controller 360 may include a plurality of processors and a plurality of memories. The processor 361 of the mobile apparatus 3 corresponding to a hardware may include a logic circuit and an arithmetic circuit, and the memory 362 may also include various types of memories. The controller 360 of the mobile apparatus 3 may be referred to as "second controller".

Some of the above-described components may be removed in the mobile apparatus 3. In addition, the mobile apparatus 3 may further include other components in addition to the above-described components.

Hereinafter operations of the home appliance 2 and the mobile apparatus 3 according to an embodiment are described in detail.

Figure 3:
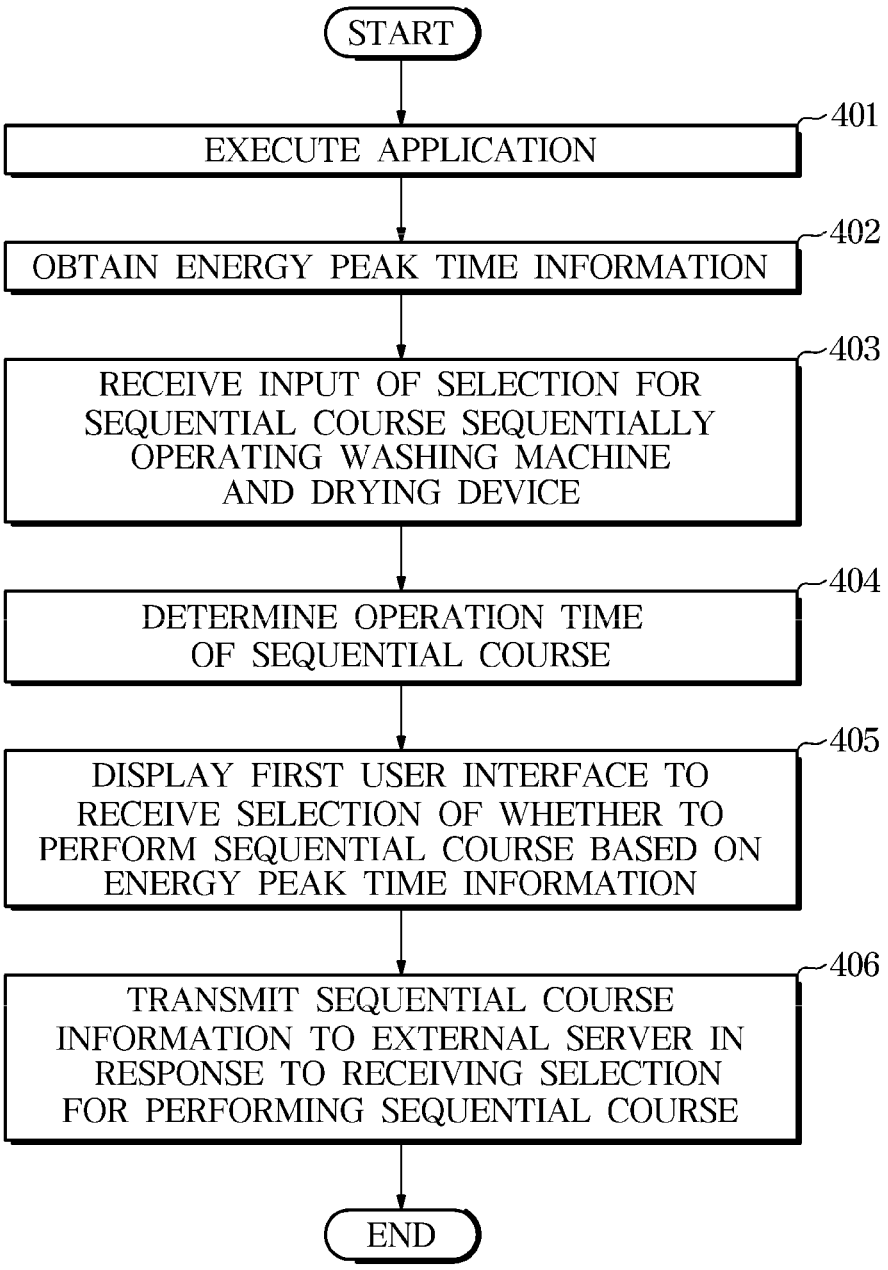
FIG. 3 is a flowchart illustrating a method of controlling home appliances according to one embodiment of the present disclosure.

FIG. 3 is a flowchart illustrating a method of controlling home appliances according to one embodiment of the present disclosure.

Referring to FIG. 3, the mobile apparatus 3 may execute an application for controlling the washing machine 2*a* for washing clothes and the drying device 2*b* or 2*c* for drying clothes (401). The external server 6 may communicate with the washing machine 2*a* and the drying device 2*b* or 2*c*. The mobile apparatus 3 may be connected to the external server 6 through the communication circuitry 310, and control the washing machine 2*a* and the drying device 2*b* or 2*c* through the external server 6.

The mobile apparatus 3 may obtain energy peak time information from the external server 6 (402). The energy peak time information may include information on energy price according to the time of the day. That is, the energy peak time information may include information on cost according to the time and information on energy consumption according to the time. Energy rates (electricity rates) corresponding to an energy peak time may be significantly more expensive than energy rates corresponding to other times. The energy peak time may be distinguished from an off-peak time. The off-peak time refers to a time that is not an energy peak time.

The energy peak time information may be predetermined by a power company and stored in the external server 6. Alternatively, the energy peak time information may be stored through a user input. A user can directly input the energy peak time and cost information through the mobile apparatus 3. A user interface for inputting the energy peak time information is described in FIGS. 5, 6 and 7.

The mobile apparatus 3 may display a first user interface 700 to receive a selection for the sequential course sequentially operating the washing machine 2*a* and the drying device 2*b* or 2*c*. The mobile apparatus 3 may receive an input of the selection for the sequential course through the first user interface 700 (403). A configuration of the user interface 700 is described in detail with reference to FIG. 8.

The mobile apparatus 3 may determine an operation time of the sequential course required to perform the sequential course and including a washing time of the washing machine 2*a* and a drying time of the drying device 2*b* or 2*c* (404). The washing time of the washing machine 2*a* may be determined based on the washing course, and the drying time of the drying device 2*b* or 2*c* may be determined based on the drying course. In addition, the drying course to be performed by the drying device 2*b* or 2*c* may be determined in accordance with the washing course. For example, the washing course may be determined as the standard washing, and a washing time may be determined as 40 minutes, and the drying course may be determined as the standard drying, and a drying time may be determined as 45 minutes.

The operation time of the sequential course may be determined by applying an interval time required to transfer the clothes from the washing machine 2*a* to the drying device 2*b* or 2*c*. In order for the washing machine 2*a* and the drying device 2*b* or 2*c* to operate in succession, the transfer of the clothes is required. Therefore, it needs to consider a transfer time of the clothes. A user needs to move the clothes to the drying device 2*b* or 2*c* after the washing course of the washing machine 2*a* is finished. Accordingly, the time required to move the clothes may vary according to a place where the washing machine 2*a* and the drying device 2*b* or 2*c* are located.

The interval time may be set by a user. The mobile apparatus 3 may provide a user interface for setting an interval time between the completion of the operation of the washing machine 2*a* and the start of the operation of the drying device 2*b* or 2*c*. In addition, the interval time may be predetermined based on a distance between the washing machine 2*a* and the drying device 2*b* or 2*c*. The interval time may be determined according to a result of learning a usage history of the sequential course. For example, the interval time may be set to 5 minutes.

The mobile apparatus 3 may display a second user interface 800 to receive a selection of whether to perform the sequential course based on the energy peak time information (405). A configuration of the user interface 800 is described in detail with reference to FIG. 9. For example, the second user interface 800 may include a button B6 for receiving a selection input for performing the sequential course while avoiding the energy peak time.

In response to receiving the selection of the sequential course, the mobile apparatus 3 may transmit sequential course information to the external server 6 (406). The sequential course information may include washing course information, drying course information and operation time. Because a user can select whether to perform the sequential course through the user interface 800, it is possible to increase a degree of freedom of the user as to whether to avoid the energy peak time.

Figure 4:
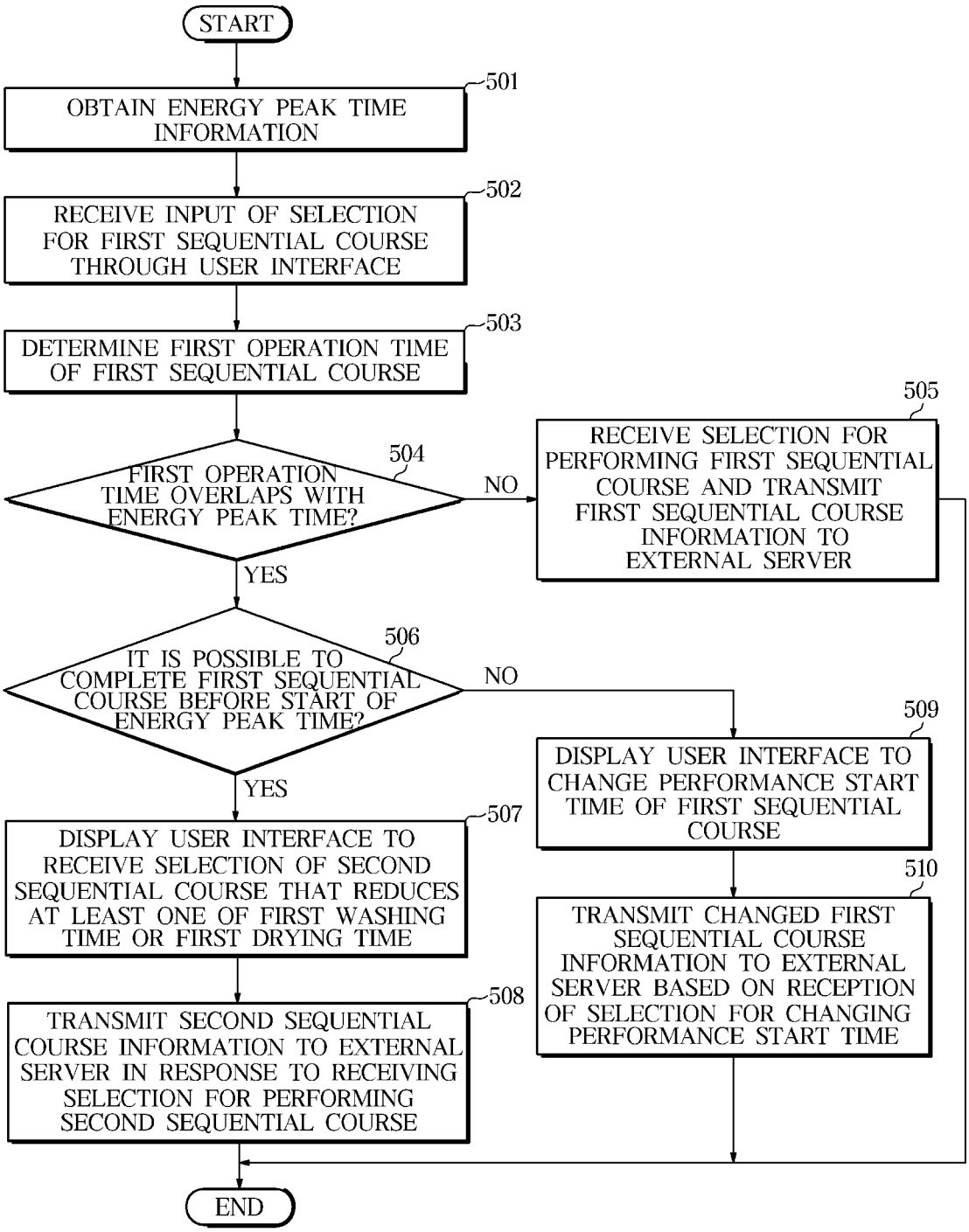
FIG. 4 is a flowchart illustrating the method of controlling the home appliances according to one embodiment of the present disclosure, in detail.

FIG. 4 is a flowchart illustrating the operation of the home appliance according to one embodiment of the present disclosure, in detail.

Referring to FIG. 4, the mobile apparatus 3 may obtain the energy peak time information from the external server 6 (501). The energy peak time information may be predetermined by a power company and stored in the external server 6. In addition, a user can directly input the energy peak time and cost information through the mobile apparatus 3. The energy peak time information obtained from the user input or the external server 6 may be stored in the memory 362 of mobile apparatus 3. The energy peak time information may be stored in the memory 252 of the home appliance 2.

The mobile apparatus 3 may obtain the energy peak time information every predetermined time period, and display a notification message notifying a change in the energy peak time information. In addition, the mobile apparatus 3 may obtain a plurality of pieces of energy peak time information provided by a plurality of power companies from the external server 6. The mobile apparatus 3 may analyze a user's usage pattern, and recommend optimal energy peak time information corresponding to the usage pattern, among a plurality of pieces of energy cost information.

The mobile apparatus 3 may receive an input for selection of a first sequential course sequentially operating the washing machine 2*a* and the drying device 2*b* or 2*c* through the user interface 700 (502). As described in FIG. 3, a user can input the selection of the first sequential course through the first user interface 700 displayed on the display 320 of the mobile apparatus 3. By the first sequential course, the washing machine 2*a* and the drying device 2*b* or 2*c* may be set to operate subsequently. The first sequential course may include a first washing course and a first drying course.

In order to perform the first sequential course, the mobile apparatus 3 may determine a first operation time of the first sequential course including a first washing time of the first washing course performed by the washing machine 2*a*, and a first drying time of the first drying course performed by the drying device 2*b* or 2*c* (503). In response to the selection of the first sequential course, the first washing time of the washing machine 2*a* and the first drying time of the drying device 2*b* or 2*c* may be set automatically.

The first washing time may include a first washing start time and a first washing end time. The first drying time may include a first drying start time and a first drying end time. A performance start time of the first sequential course may be the same as the first washing start time. A performance end time of the first sequential course may be the same as the first drying end time. Further, the first operation time of the first sequential course may be determined by applying the interval time required to transfer the clothes from the washing machine 2*a* to the drying device 2*b* or 2*c*.

Meanwhile, the mobile apparatus 3 may set the performance start time of the first sequential course based on a user input, and may determine the performance end time of the first sequential course based on the performance start time of the first sequential course. For example, a current time may be 11:15 a.m., the first operation time of the first sequential course may be 1 hour and 30 minutes, and the performance start time of the first sequential course may be 11:20 a.m., inputted by a user. In this case, the mobile apparatus 3 may determine the performance end time of the first sequential course as 12:50 μm. The mobile apparatus 3 may determine whether the first operation time of the first sequential course overlaps with the energy peak time (504). The mobile apparatus 3 may determine a range in which the first operation time of the first sequential course and the energy peak time overlaps with each other. For example, the mobile apparatus 3 may identify that the first washing time belongs to the off-peak time but the first drying time overlaps with the energy peak time. In addition, the mobile apparatus 3 may display the second user interface 800 to select whether to perform the first sequential course based on the energy peak time and the first operation time.

When the first operation time of the first sequential course does not overlap with the energy peak time, the mobile apparatus 3 may transmit first sequential course information including first washing course information and first drying course information to the external server 6 in response to receiving the selection of the first sequential course through the second user interface 800 (505). The external server 6 may transmit the first sequential course information to washing machine 2*a*, and the drying device 2*b* or 2*c*. In other words, based on the entire first operation time of the first sequential course belonging to the off-peak time, the washing machine 2*a* and the drying device 2*b* or 2*c* may be operated based on the determined first operation time of the first sequential course.

Based on the first operation time of the first sequential course overlapping with the energy peak time, the mobile apparatus 3 may determine whether it is possible to complete the first sequential course before the start of the energy peak time (506). The mobile apparatus 3 may display a third user interface 900 to receive a selection for a second sequential course, which requires a second operation time less than the first operation time, based on the determination that it is possible to complete the first sequential course before the start of the energy peak time (507). A configuration of the third user interface 900 will be described with reference to FIG. 10.

Based on the reception of the input for the selection of the second sequential course through the third user interface 900, the mobile apparatus 3 may select the second sequential course in which at least one of the first washing time of the washing machine 2*a* or the first drying time of the drying device 2*b* or 2*c* is reduced. The mobile apparatus 3 may reduce at least one of the washing time or the drying time based on a predetermined minimum washing time and a predetermined minimum drying time.

For example, the mobile apparatus 3 may maintain the first washing time of the first washing course, and select a second drying course that requires a second drying time less than the first drying time of the first drying course. In this case, the second operation time of the second sequential course includes the first washing time and the second drying time. As another example, the mobile apparatus 3 may maintain the first drying time of the first drying course, and select a second washing course that requires a second washing time less than the first washing time of the first washing course. In this case, the second operation time of the second sequential course includes the second washing time and the first drying time.

In response to receiving the selection of the second sequential course through the third user interface 900, the mobile apparatus 3 may transmit second sequential course information to the external server 6 (508). As illustrated, the second sequential course information may include the first washing course information and the second drying course information, or the second washing course information and the first drying course information.

The mobile apparatus 3 may display the third user interface 900 to change the performance start time of the first sequential course based on the energy peak time information. For example, in the operation 506, the mobile apparatus 3 may display the third user interface 900 to change the performance start time of the first sequential course based on the determination that it is impossible to complete the first sequential course before the start of the energy peak time (509). The mobile apparatus 3 may set the performance start time of the first sequential course based on a user input, and determine the performance end time of the first sequential course based on the performance start time of the first sequential course. Based on the reception of the selection to change the performance start time, the mobile apparatus 3 may transmit the changed first sequential course information to the external server 6 (510).

For example, the mobile apparatus 3 may change at least one of the first washing start time of the washing machine 2*a* or the first drying start time of the drying device 2*b* or 2*c*. In other words, the mobile apparatus 3 may move at least one of the first washing start time of the washing machine 2*a* or the first drying start time of the drying device 2*b* or 2*c* to the off-peak time. Particularly, based on a range in which the first operation time of the first sequential course overlaps with the energy peak time, the mobile apparatus 3 may move both of the first washing start time and the first drying start time to the off-peak time or move one of the first washing start time and the first drying start time to the off-peak time.

As mentioned above, when a user uses the home appliances 2, the disclosed home appliance system 1 and mobile apparatus 3 may adjust the operation time of the home appliances to allow the operation time of the home appliances to avoid the energy peak time and provide a guide about the energy peak time. The use can avoid the energy peak time so as to save energy cost.

Figure 5:
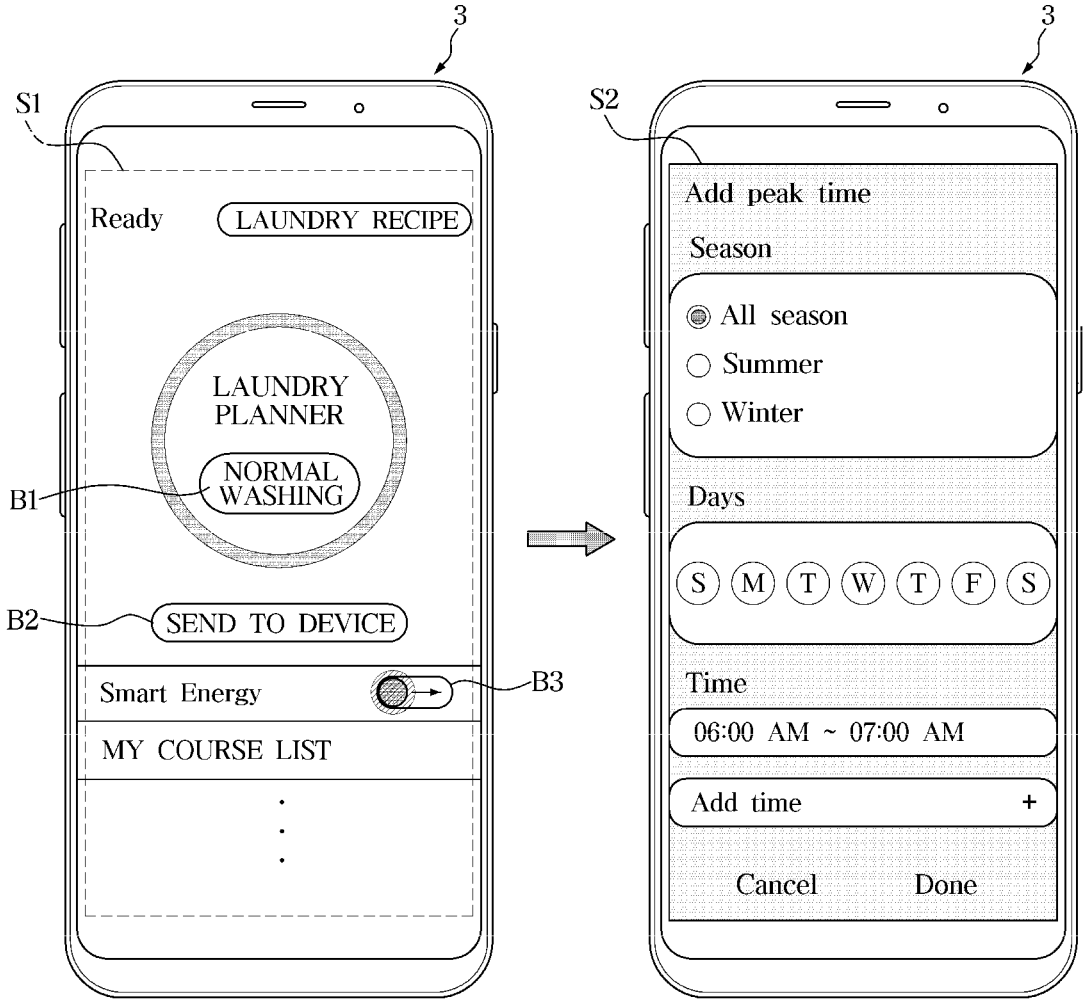
FIG. 5 is a view illustrating an example of a user interface for setting an energy peak time.
Figure 6:
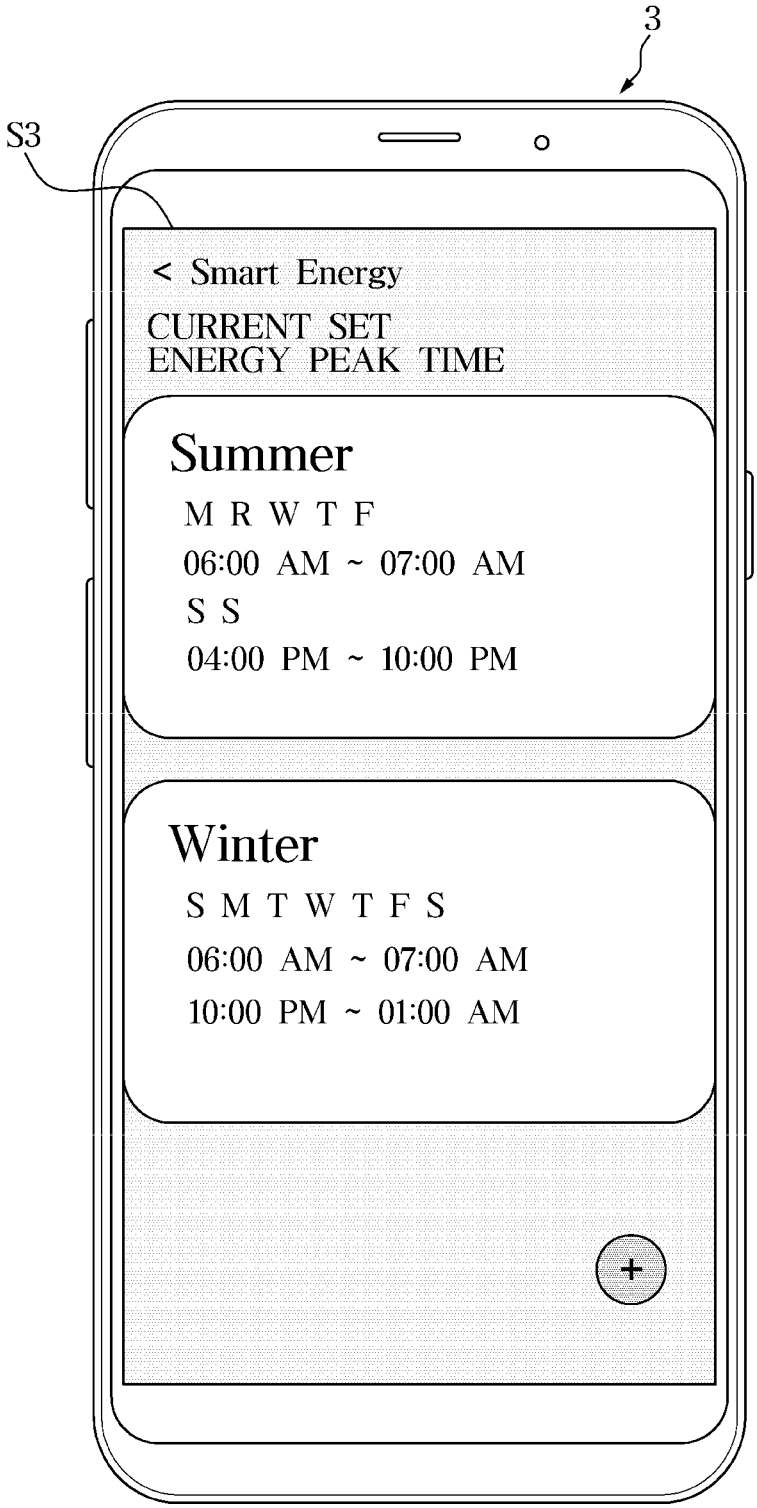
FIG. 6 is a view illustrating an example of a screen showing an energy peak time set through the user interface of FIG. 5.

FIG. 5 is a view illustrating an example of a user interface for setting an energy peak time. FIG. 6 is a view illustrating an example of a screen showing an energy peak time set through the user interface of FIG. 5.

Referring to FIG. 5, in response to executing an application, the mobile apparatus 3 may display a home screen S1 for controlling the home appliances 2 on the display 320 of the mobile apparatus 3.

The home screen S1 may include various user interface elements. The user interface provided by the mobile apparatus 3 may perform various functions by interacting with a user input. For example, a course button B1 for selecting an operation course or operation mode of the home appliances 2, a send button B2 for transmitting an operation parameter determined according to the selected operation course, to the home appliances 2, and a smart energy button B3 for setting an energy peak time may be displayed on the display 320 of the mobile apparatus 3.

In response to receiving the input for the course button B1, various operation courses selectable for operating the home appliances 2 may be displayed. For example, the washing course for the washing operation of the washing machine 2*a*, the drying course for the drying operation of the drying device 2*b* or 2*c* and the sequential course for sequentially operating the washing machine 2*a* and the drying device 2*b* or 2*c* may be provided. A user can operate the washing machine 2*a* and the drying device 2*b* or 2*c* by selecting a desired course.

The home appliances 2 may be operated based on an operation course selected among the plurality of operation courses. Operating parameters of the washing machine 2*a* may be determined by the selected washing course, and the operating parameters may include a washing temperature, the number of rinses, a washing time and a spin-dry strength. Operating parameters of the drying device 2*b* or 2*c* may be determined by the selected drying course, and the operating parameters may include a drying temperature, a drying time and a drying strength.

In response to the activation of the smart energy button B3 by a user input, a setting screen S2 configured to receive an energy peak time may be displayed on the display 320 of the mobile apparatus 3. On the energy peak time setting screen S2, season selection items, day selection items and time selection items may be included. For example, a user can select one of all season, summer or winter. In addition, a user can select the day of the week to set the energy peak time from Monday to Sunday. In addition, a user can specify the energy peak time.

Referring to FIG. 6, in response to the completion of the input of the energy peak time, a screen S3 including the set energy peak time information may be displayed on the display 320 of the mobile apparatus 3. The energy peak time information may be set to be a plurality of pieces of information according to a user input. For example, during the summer period, the energy peak time may be set from 6:00 to 7:00 a.m. on Monday, Tuesday Wednesday, Thursday and Friday and the energy peak time may be set from 4:00 to 10:00 p.m. on Saturday and Sunday. In addition, during the winter period, the energy peak time may be set from 6:00 to 7:00 a.m. on Monday, Tuesday Wednesday, Thursday and Friday and the energy peak time may be set from 10:00 p.m. to 1:00 a.m. on Saturday and Sunday.

In response to the activation of the smart energy button B3 by a user input, the mobile apparatus 3 may obtain the energy peak time information from the external server 6 and display the obtained energy peak time information. In this case, the setting screen S2 may not be displayed.

Figure 7:
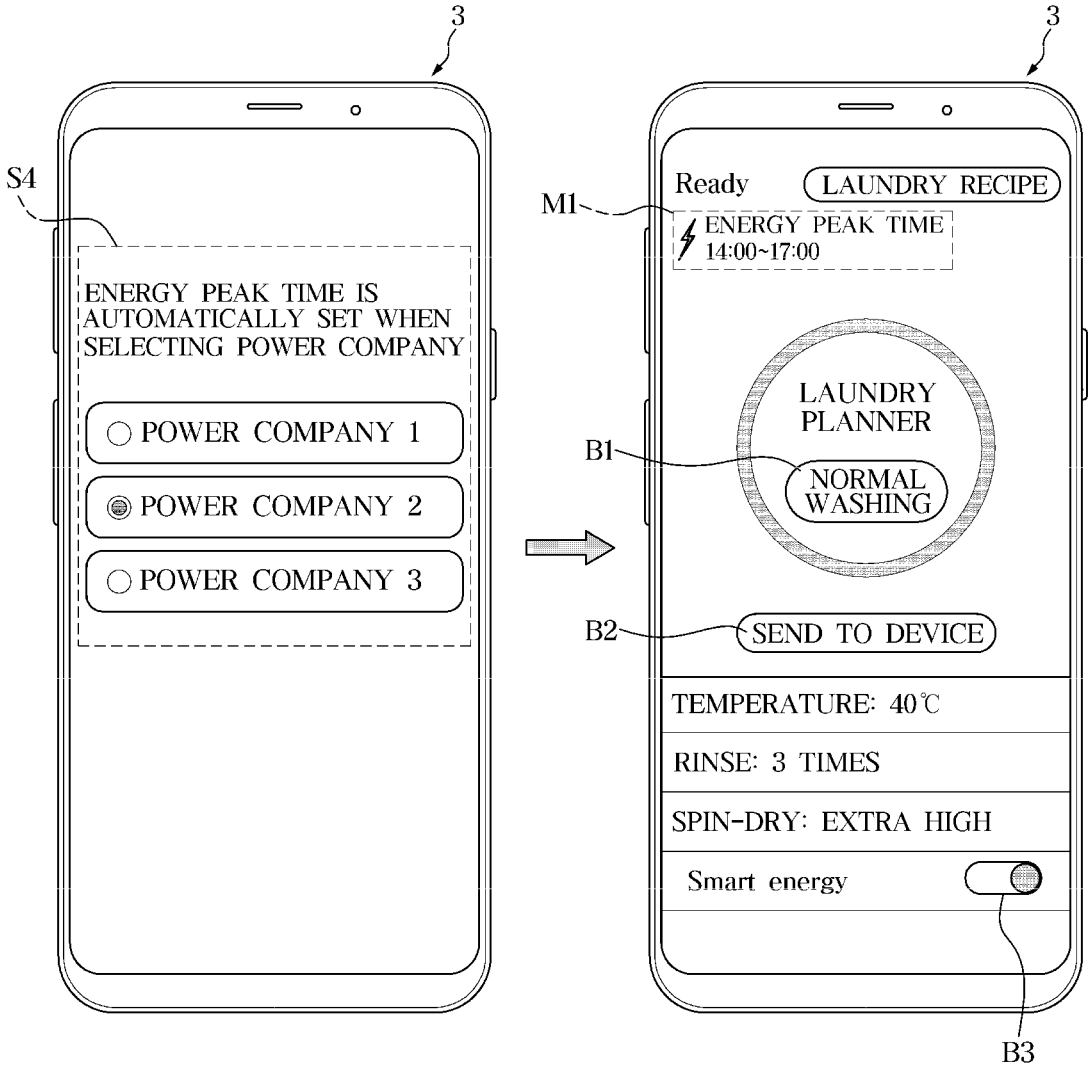
FIG. 7 is a view illustrating another example of the user interface for setting an energy peak time.

FIG. 7 is a view illustrating another example of the user interface for setting an energy peak time.

Referring to FIG. 7, on the display 320 of the mobile apparatus 3, a screen S4 for guiding selection of one of a plurality of power companies may be displayed. In Europe and Japan, there are multiple power companies, a user can use electricity by selecting the desired power company. In addition, a user can also choose a desired electricity rate plan. The mobile apparatus 3 may obtain a plurality of pieces of energy peak time information provided by the plurality of power companies from the external server 6.

In response to one power company being selected by a user among the plurality of power companies, an energy peak time may be automatically set based on the energy peak time information provided by the selected power company.

A peak time M1 may be displayed on the display 320 of the mobile apparatus 3. FIG. 7 illustrates that the energy peak time is set from 14:00 to 17:00.

In addition, the mobile apparatus 3 may analyze a user's usage pattern, and recommend optimal energy peak time information corresponding to the usage pattern, among the plurality of pieces of energy peak time information.

Figure 8:
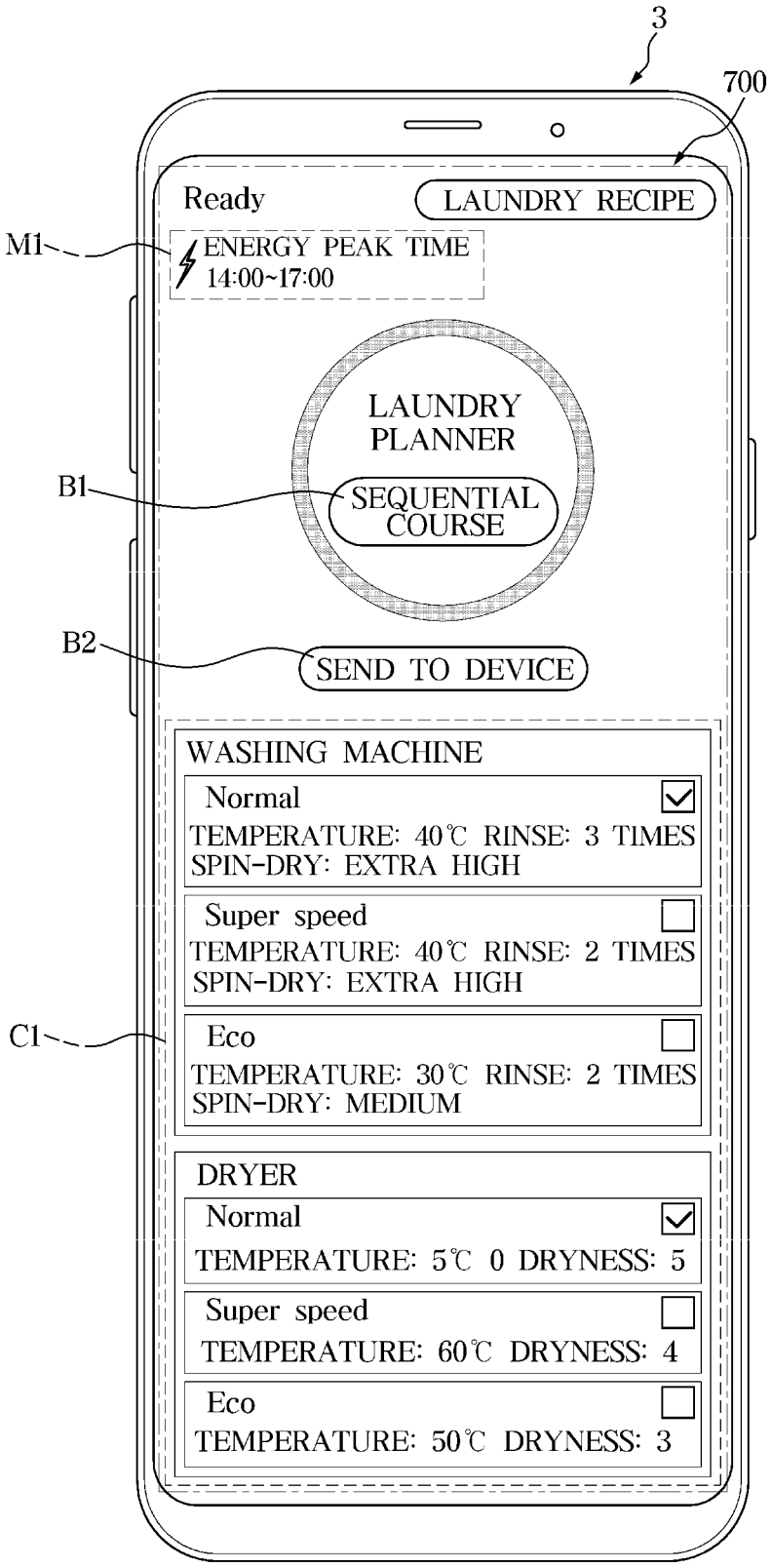
FIG. 8 is a view illustrating an example of a first user interface for selecting a sequential course sequentially operating a washing machine and a drying device.

FIG. 8 is a view illustrating an example of the first user interface 700 for selecting the sequential course sequentially operating the washing machine and the drying device.

Referring to FIG. 8, the mobile apparatus 3 may display the first user interface 700 for the selection of the sequential course. A user can select the sequential course by manipulating the course button B1. In response to the selection of the sequential course, a submenu Cl of the sequential course including the operation courses for each of the washing machine 2*a* and the drying device 2*b* or 2*c* may be displayed on the display 320 of the mobile apparatus 3. For example, "Normal", "Super-speed", and "Eco", which correspond to the operation course of each of the washing machine 2*a* and the drying device 2*b* or 2*c*, may be displayed. FIG. 8 illustrates that the operation courses of the washing apparatus 2*a* and the drying device 2*b* or 2*c* are respectively selected as "Normal". The normal course may be referred as a standard course, the super speed course may be referred as a quick course, and the eco-course may be referred as a save course.

In addition, in response to the selection of the sequential course, the mobile apparatus 3 may determine an operation time of the sequential course including the washing time of the washing machine 2*a* and the drying time of the drying device 2*b* or 2*c*. For example, the washing time of the washing machine 2*a* corresponding to the normal course may be 40 minutes, the drying time of the drying device 2*b* or 2*c* corresponding to the normal course may be 45 minutes. The interval time required for the clothes to be transferred from the washing machine 2*a* to the drying device 2*b* or 2*c* may be determined to be 5 minutes. Therefore, the operation time of the sequential course may be determined to be 1 hour and 30 minutes.

Figure 9:
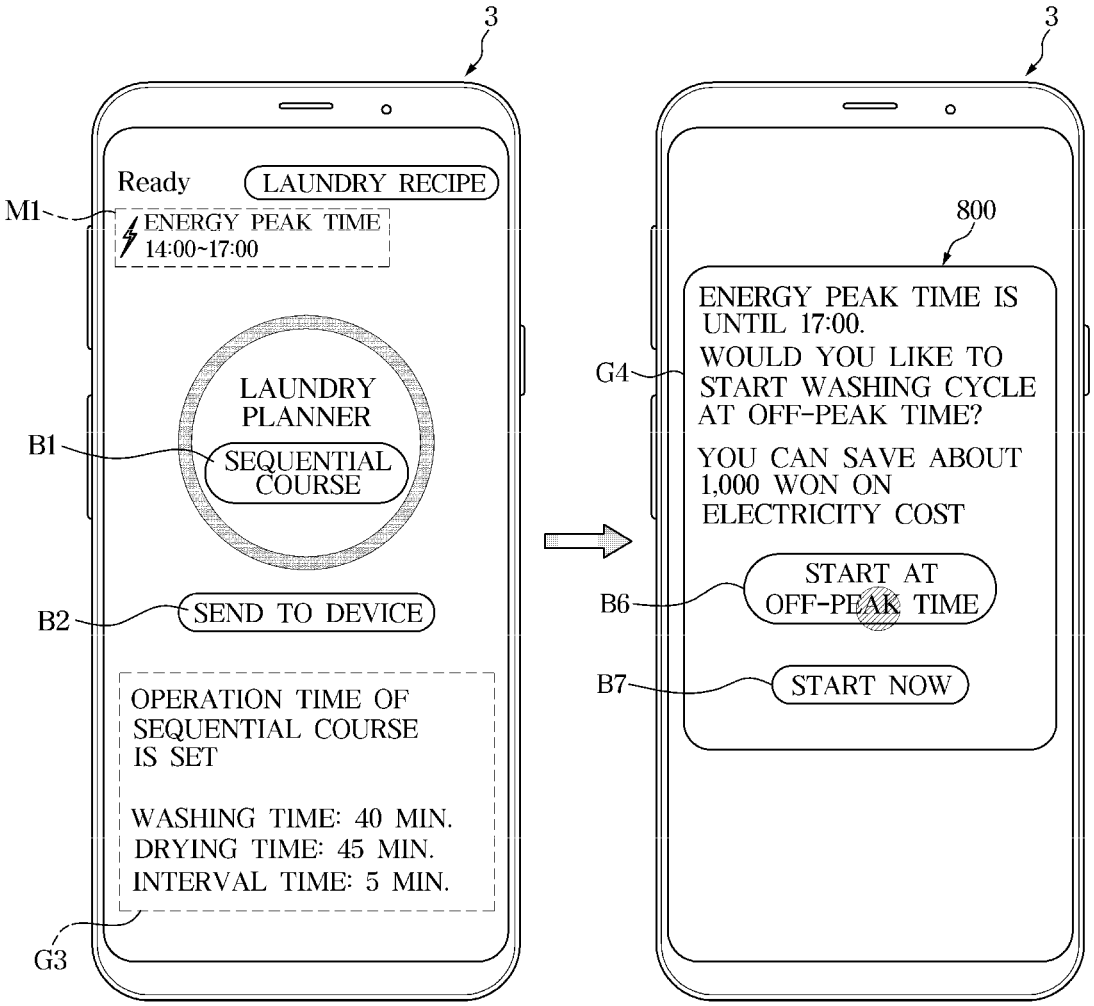
FIG. 9 is a view illustrating an example of a second user interface for receiving a selection for performing the sequential course.

FIG. 9 is a view illustrating an example of the second user interface 800 for receiving a selection for performing the sequential course.

Referring to FIG. 9, the mobile apparatus 3 may display the determined operation time of the sequential course after receiving the input of the selection of the sequential course through the first user interface 700 of FIG. 8. For example, time information in which the washing time is 40 minutes, the drying time is 45 minutes, and the interval time is 5 minutes may be displayed in a time information field G3.

The mobile apparatus 3 may display the second user interface 800 for receiving the selection of whether to perform the sequential course based on the energy peak time information. For example, when a user touches the display 320 of the mobile apparatus 3 or a predetermined time is expired after the operation time of the sequential course is displayed, the second user interface 800 may be displayed.

The second user interface 800 may include a pop-up window G4 including energy peak time information and a query on whether to perform the sequential course. In addition, the second user interface 800 may include a button for receiving a selection input for performing the sequential course while avoiding the energy peak time.

For example, the pop-up window G4 may include an end time of the energy peak time (for example, 17:00), cost saving information (for example, saving 1,000 won (Korean currency)), a first button B6 for selecting to perform the sequential course at the off-peak time and a second button B7 for selecting to immediately perform the sequential course. The first button B6 and the second button B7 may be displayed as various text and/or images. For example, in FIG. 9, the first button B6 may be displayed as "start at off-peak time" and the second button B7 may be displayed as "start now".

Figure 10:
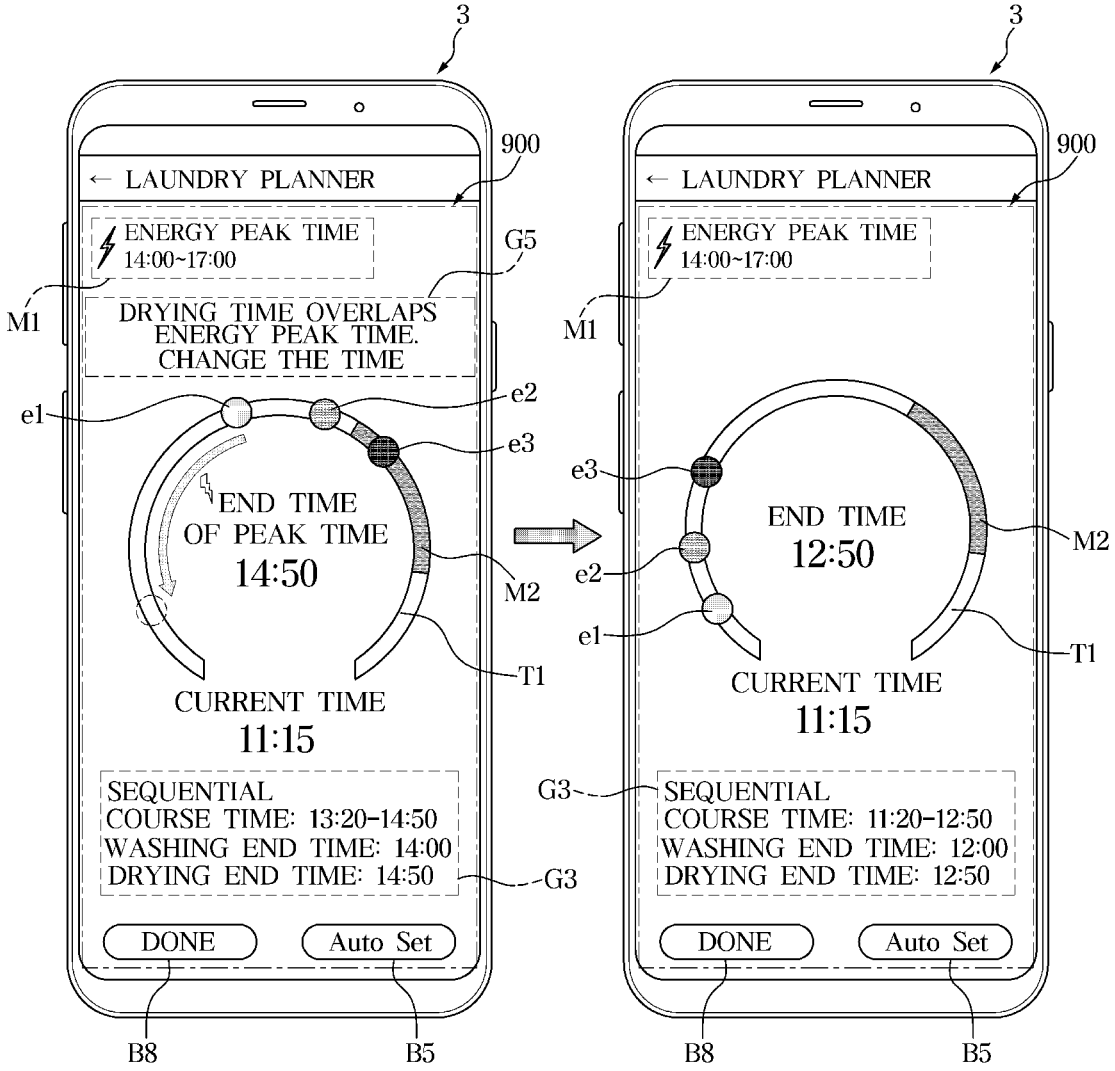
FIG. 10 is a view illustrating an example of a third user interface for changing an operation time of the sequential course.

FIG. 10 is a view illustrating an example of the third user interface 900 for changing an operation time of the sequential course.

Referring to FIG. 10, after receiving the selection through the user interface 800 to perform the sequential course at the off-peak time, the mobile apparatus 3 may display the third user interface 900 to set the operation time of the sequential course.

The third user interface 900 may include a timeline T1, a peak time M1, a time information field G3, a warning message G5, a current time and a sequential course end time. In addition, the third user interface 900 may further include an auto set button B5 and a completion button B8.

A performance start time of a sequential course, a performance end time of a sequential course, a washing end time, and a drying end time may be displayed on the time information field G3. The time information displayed in the time information field G3 may be changed according to the movement of time control elements e1, e2, and e3.

The mobile apparatus 3 may display the warning message G5 informing that a currently set operation time of the sequential course overlaps with an energy peak time. For example, when a drying time of the currently set sequential course overlaps with the energy peak time, the warning message G5 "drying time overlaps with energy peak time. Please change the time" may be displayed. FIG. 10 illustrates that the warning message G5 is displayed because the currently set drying end time belongs to the energy peak time.

In addition, the third user interface 900 may include a first control element e1 for adjusting a performance start time of a sequential course (washing start time), a second control element e2 for adjusting a washing end time, and a third control element e3 for adjusting a drying end time (end time of the sequential course).

Figure 11:
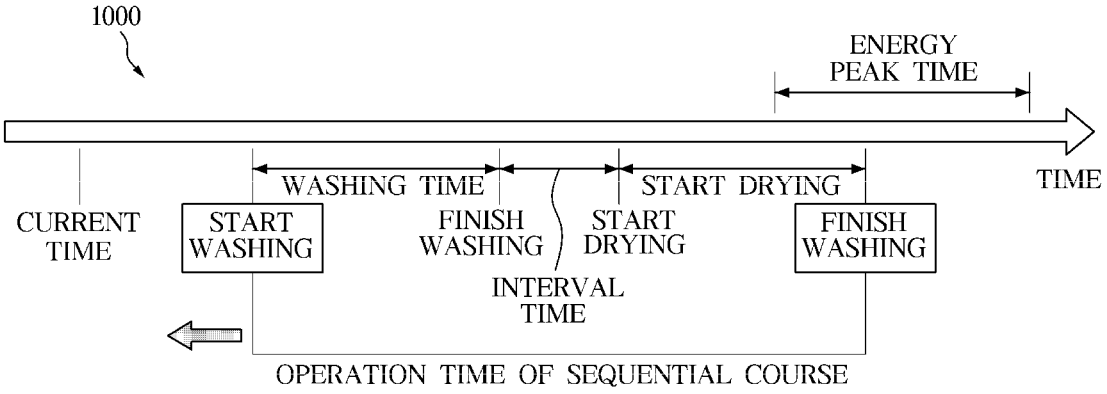
FIG. 11 is a time line illustrating an embodiment in which the operation of time of the sequential course is adjusted when there is a possibility in which the sequential course is completed before the start of an energy peak time.
Figure 12:
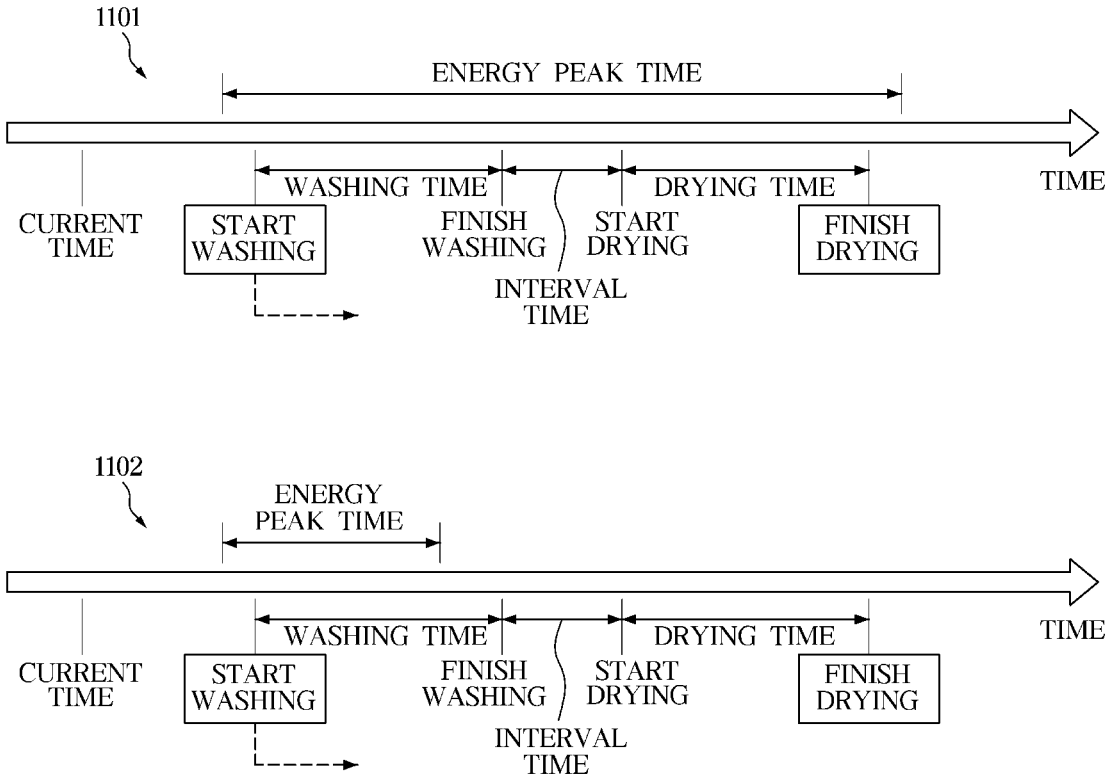
FIG. 12 is a time line illustrating an embodiment in which a washing start time is delayed according to an overlapping range of the energy peak time and the operation time of the sequential course.
Figure 13:
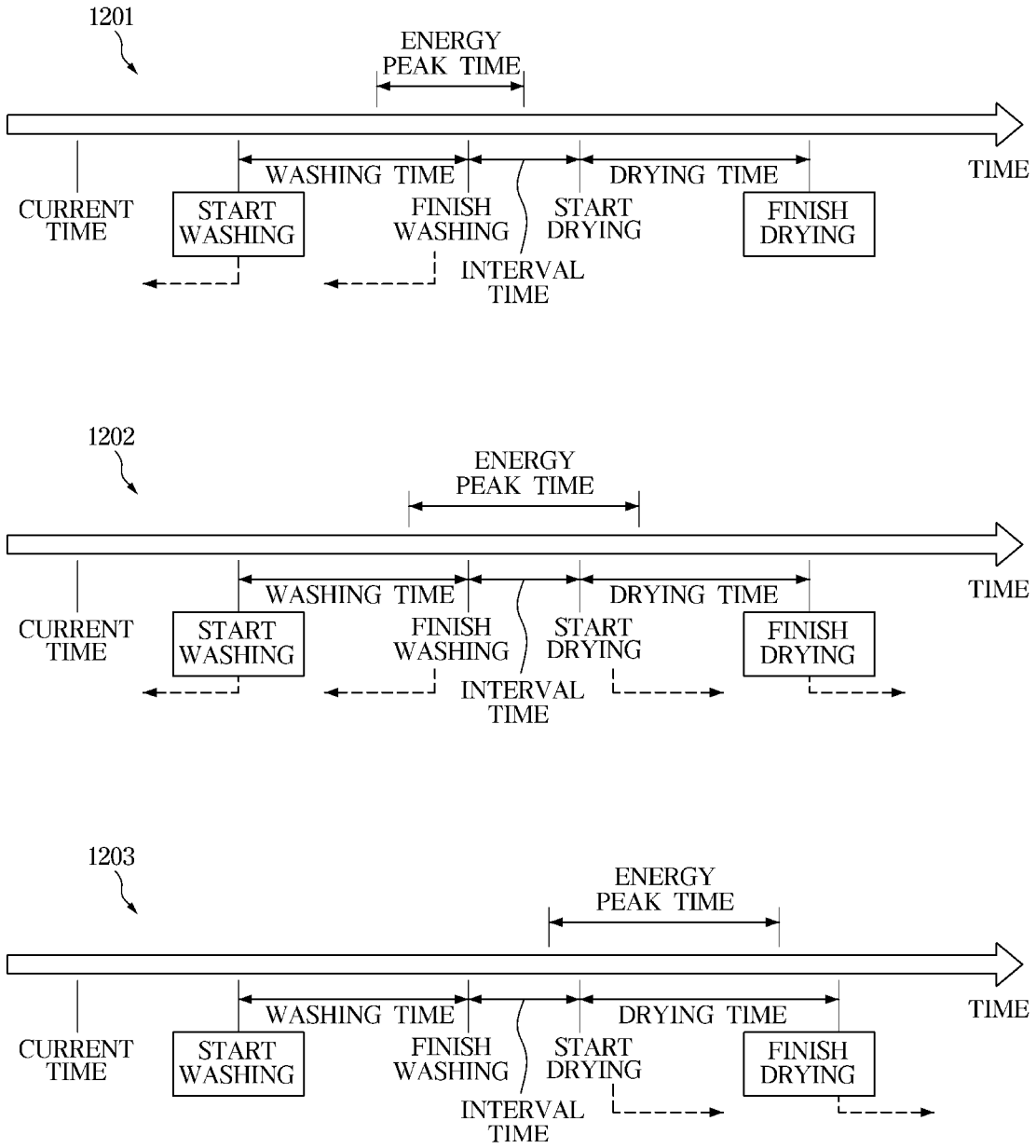
FIG. 13 is a time line illustrating an embodiment in which at least one of a washing time and a drying time is changed according to the overlapping range of the energy peak time and the operation time of the sequential course.

The first control element e1, the second the control element e2 and the third control element e3 may be sequentially displayed on a circular timeline T1 indicating a passage of time. A mark M2 indicating an energy peak time may be displayed on the circular timeline T1. As shown in FIGS. 11, 12 and 13, a linear timeline may be displayed. The first control element e1, the second the control element e2 and the third control element e3 may be movable on the timeline. Although not shown, a fourth control element (not shown) for adjusting a drying start time may be arranged between the second control element e2 and the third control element e3.

By manipulating at least one of the first control element e1, the second the control element e2 and the third control element e3, a user can set the performance start and/or end time of the sequential course. That is, the mobile apparatus 3 may change the performance start time of the first sequential course based on a user input that moves the time control elements e1, e2, and e3. The mobile apparatus 3 may determine the performance end time of the first sequential course based on the performance start time of the first sequential course. In response to receiving the user input for the completion button B8, the mobile apparatus 3 may receive a selection for changing the performance start time of the first sequential course.

For example, when the first control element e 1 is moved to the left along the circular timeline T1 by the user manipulation, the performance start time of the sequential course may be advanced. As the performance start time of the sequential course is advanced, the performance end time of the sequential course may be automatically advanced. A current time may be 11:15 a.m., the first operation time of the first sequential course may be 1 hour and 30 minutes, and the performance start time of the first sequential course changed by the user may be 11:20 a.m. In this case, the mobile apparatus 3 may determine the performance end time of the first sequential course as 12:50 p.m.

In addition, a second sequential course, which requires a second operation time less than the first operation time, may be selected through the third user interface 900. For example, by the time control elements e1, e2, and e3, a second sequential course including the first washing time of the first washing course and a second drying course that requires a second drying time less than the first drying time of the first drying course, may be selected. As another example, by the time control elements e1, e2, and e3, a second sequential course including a second washing course that requires a second washing time less than the first washing time of the first washing course and the first drying course that requires the first drying time, may be selected.

In addition, the interval time between the completion of the operation of the washing machine 2*a* and the start of the operation of the drying device 2*b* or 2*c* may be set through the third user interface 900. The interval time may be changed by the second control element e2 for adjusting the washing end time and the fourth control element (not shown) for adjusting the drying start time.

In response to receiving the user input for the auto set button B5, the operation time of the sequential course may be automatically set as the optimal off-peak time. Through the auto set button B5, the mobile apparatus 3 may receive a selection for automatically setting the optimal operation time of the sequential course that avoids the energy peak time. In this case, the positions of the time control elements e1, e2, and e3 may be automatically changed. In addition, through the completion button B8, the mobile apparatus 3 may receive a selection for applying the optimal operation time of the sequential course.

FIG. 11 is a time line illustrating an embodiment in which the operation of time of the sequential course is adjusted when there is a possibility in which the sequential course is completed before the start of an energy peak time.

Referring to FIG. 11, in response to the operation time of the sequential course overlapping with the energy peak time, the mobile apparatus 3 may determine whether it is possible to complete the sequential course before the start of the energy peak time. In a timeline 1000 of FIG. 11, it is illustrated that the drying end time is located within the energy peak time range, and a part of the drying time overlaps with the energy peak time. In this case, it is possible to avoid the energy peak time by reducing the operation time of the sequential course.

The mobile apparatus 3 may reduce at least one of the washing time or the drying time to avoid the energy peak time. The washing time means a time range from a washing start time to a washing end time, and the drying time means a time range from a drying start time to a drying end time. The reduction of the washing time and the drying time may be performed based on a predetermined minimum washing time and a predetermined minimum drying time. The minimum washing time may be a lower limit value capable of providing a washing effect, and the minimum drying time may be a lower limit capable of providing a drying effect. In other words, in order to complete the sequential course before the start of the energy peak time, the washing time may be reduced to the minimum washing time, and the drying time may be reduced to the minimum drying time.

For example, the energy peak time may be from 14:00 to 17:00. In response to the selection of the first sequential course through the first user interface 700, the mobile apparatus 3 may determine the first washing time as 40 minutes, the first interval time as 5 minutes, the first drying time as 45 minutes, and the first drying end time as 14:15. In this case, 15 minutes in the drying time belongs to the energy peak time. In addition, the predetermined minimum washing time may be 30 minutes, and the predetermined minimum drying time may be 40 minutes. In this case, the mobile apparatus 3 may determine a second operation time of the second sequential course that is completed before the start of the energy peak time.

In order to secure the maximum washing performance and the maximum drying performance while avoiding the energy peak time, the mobile apparatus 3 may determine a period of time, which is obtained by subtracting 8 minutes from the first washing time, as a second washing time, and determine a period of time, which is obtained by subtracting 7 minutes from the first drying time, as a second drying time. Due to the reduction in the washing time and the drying time, the performance end time of the second sequential course may be 14:00. Therefore, the second sequential course may be completed before the start of the energy peak time. The second sequential course that requires the second operation time less than the first operation time may be automatically set through the auto set button B5 included in the third user interface 900 or may be manually set through a user manipulation of the time control elements e1, e2, and e3.

When the performance start time of the sequential course is reserved for a future time, the mobile apparatus 3 may change the performance start time of the sequential course to be advanced. For example, a current time may be 11:15, a performance end time of the first sequential course may be 14:15, and a performance start time of the first sequential course may be 12:45. In order to complete the first sequential course before the start of the energy peak time (for example, 14:00), the mobile apparatus 3 may advance the performance start time of the first sequential course by 20 minutes and set the performance start time of the sequential course as 12:25 in response to the user input through the third user interface 900. Therefore, the first sequential course may be completed at 13:55 before the start of the energy peak time.

The performance start time of the first sequential course may be automatically set through the auto set button B5 included in the third user interface 900 or may be manually set through a user manipulation of the time control elements e1, e2, and e3. Further, the performance end time of the first sequential course (the first drying end time) and the first drying start time may be automatically or manually changed.

In addition, reducing the washing time and the drying may be performed together with advancing the performance start time of the sequential course.

FIG. 12 is a time line illustrating an embodiment in which a washing start time is delayed according to an overlapping range of the energy peak time and the operation time of the sequential course.

Based on the determination that it is impossible to complete the sequential course before the start of the energy peak time, the mobile apparatus 3 may move at least one of the washing time or the drying time to the off-peak time. The movement of the washing time means the movement of the washing start time and the washing end time, and the movement of the drying time means the movement of the drying start time and the drying end time. According to an overlapping range of the operation time of the sequential course and the energy peak time, only the washing time may be moved and the drying time may not be moved. Alternatively, only the drying time may be moved and the washing time may not be moved. Alternatively, both of the washing time and the drying time may be moved.

On a first timeline 1101 of FIG. 12, it is illustrated that the overlapping range between the operation time of the sequential course and the energy peak time is the entire operation time of the sequential course. Because a time range from the current time to the washing start time is less than the overlapping range of the energy peak time, it is impossible to avoid the energy peak time through a method of reducing or advancing the operation time of the sequential course. Accordingly, the mobile apparatus 3 may move the washing time to after the energy peak time. As washing time is delayed and changed, the entire operation time of the sequential course is delayed to after the energy peak time.

On a second timeline 1102 of FIG. 12, it is illustrated that the overlapping range of the operation time of the sequential course and the energy peak time is a partial range of the washing time. The washing start time belongs to the energy peak time. Because a time range from the current time to the washing start time is less than the entire operation time of the sequential course, it is impossible to avoid the energy peak time through a method of advancing the washing start time. Accordingly, the mobile apparatus 3 may move the entire operation time of the sequential course to after the energy peak time.

FIG. 13 is a time line illustrating an embodiment in which at least one of a washing time and a drying time is changed according to the overlapping range of the energy peak time and the operation time of the sequential course.

On a first timeline 1201 of FIG. 13, it is illustrated that the energy peak time overlaps with a time range from a middle of the washing time to the washing end time. Further, it is illustrated that a time range from a current time to the washing start time is greater than an overlapping range between the washing time and the energy peak time. In this case, it is possible to avoid the energy peak time by advancing the washing start time. That is, the mobile apparatus 3 may move the washing time to before the energy peak time. Because the drying time does not overlap with the energy peak time, the drying device 2*b* or 2*c* may be operated at the drying time specified by a user.

On a second timeline 1202 of FIG. 13, it is illustrated that the energy peak time overlaps with a time range from a middle of the washing time to a middle of the drying time. Further, it is illustrated that a time range from a current time to the washing start time is greater than an overlapping range between the washing time and the energy peak time. In this case, it is possible to avoid the energy peak time by advancing the washing start time and by delaying the drying start time. That is, the mobile apparatus 3 may move the washing time to before the energy peak time, and move the drying time to after the energy peak time.

On a third timeline 1203 of FIG. 13, it is illustrated that the energy peak time overlaps with a time range from the drying start time to a middle of the drying time. In this case, the mobile apparatus 3 may move the drying time to after the energy peak time. It is possible to avoid the energy peak time by delaying the drying time. Because the washing time does not overlap with the energy peak time, the washing machine 2*a* may be operated at the washing time specified by a user.

Meanwhile, the overlap of the energy peak time and the interval time may not affect the change of the operation time of the sequential course. When the energy peak time overlaps with only the interval time, it is not required to adjust the operation time of the sequential course. This is because the washing machine 2*a* and the drying device 2*b* or 2*c* are not operated during the interval time.

In addition, the mobile apparatus 3 may adjust or change the washing time and drying time to allow the sequential course end time to be delayed to a minimum. As mentioned above, in order to avoid the energy peak time, the operation time of the sequential course may be optimized according to the overlapping range of the operation time of the sequential course and the energy peak time.

Figure 14:
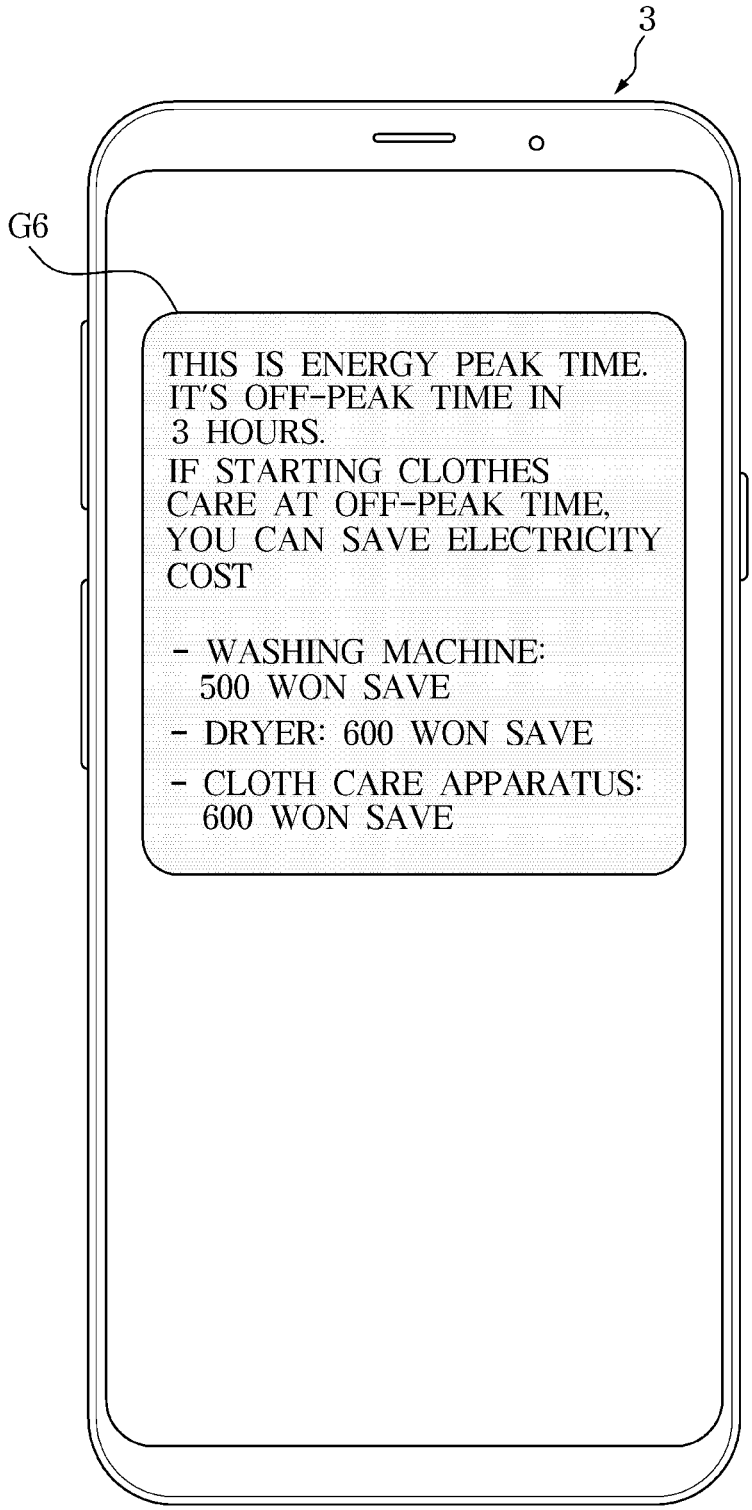
FIG. 14 is a view illustrating an example of a screen providing a notification of the start of the energy peak time.
Figure 15:
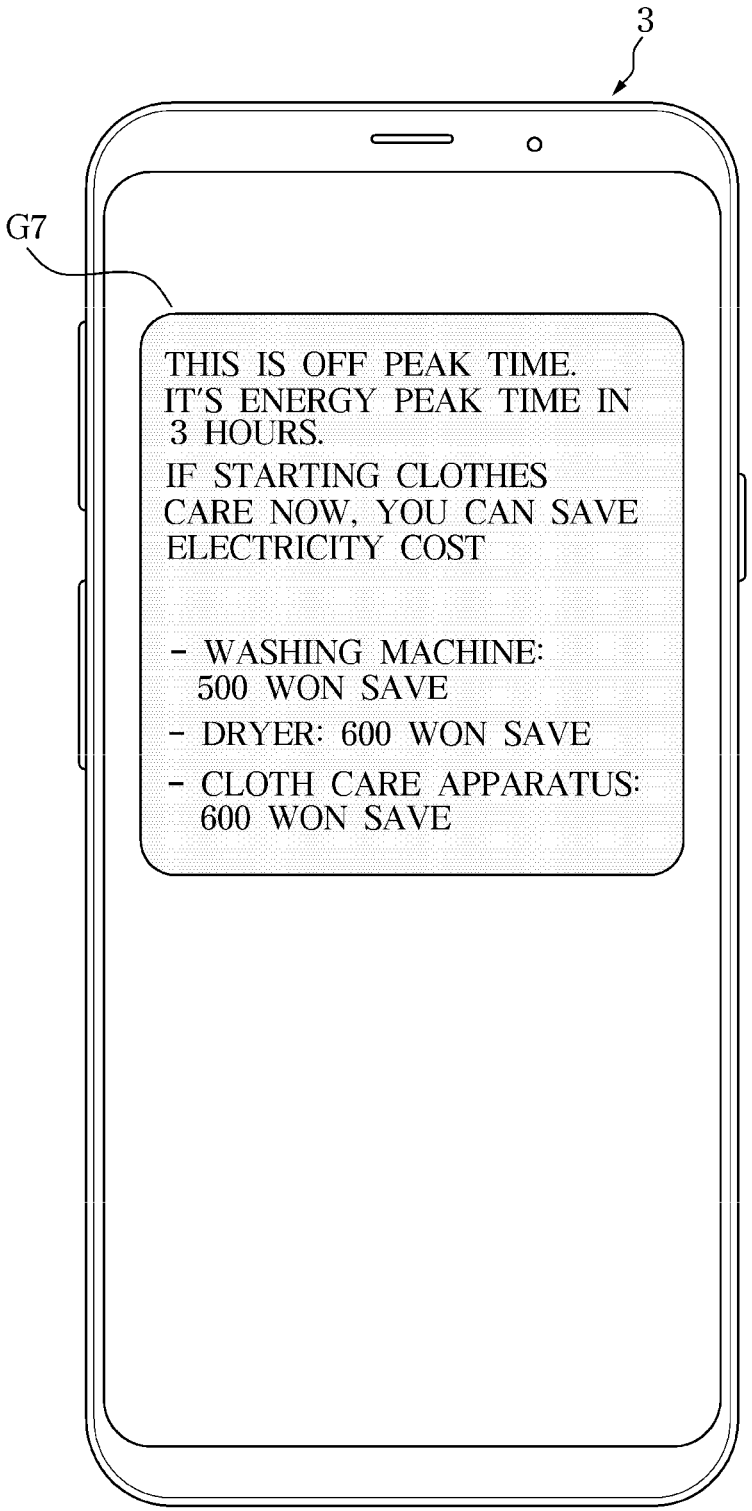
FIG. 15 is a view illustrating an example of a screen providing a notification of the start of off-peak time.
Figure 16:
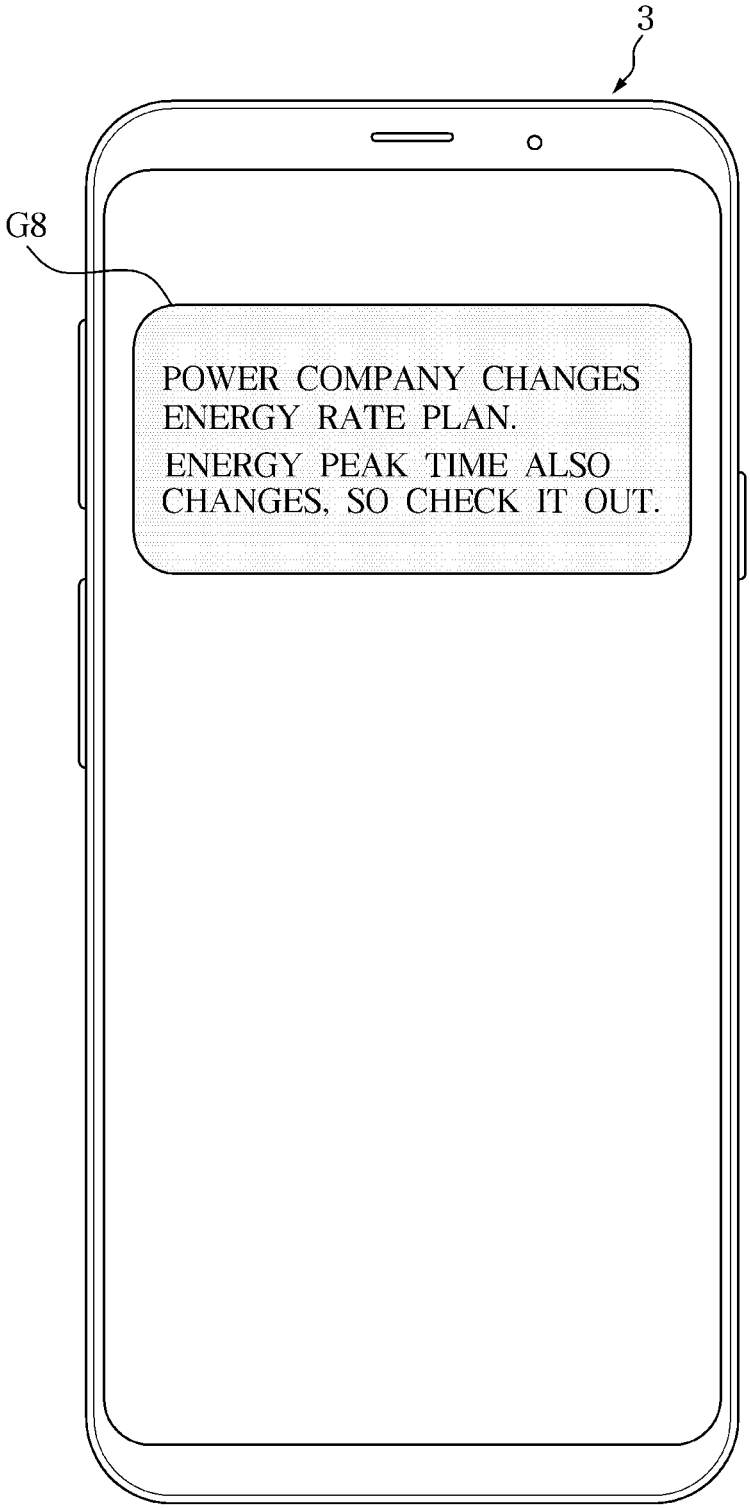
FIG. 16 is a view illustrating an example of a screen providing a notification of change in energy cost information.

FIG. 14 is a view illustrating an example of a screen providing a notification of the start of the energy peak time. FIG. 15 is a view illustrating an example of a screen providing a notification of the start of off-peak time. FIG. 16 is a view illustrating an example of a screen providing a notification of change in energy peak time information.

Referring to FIG. 14, in response to the start of the energy peak time, the mobile apparatus 3 may display a pop-up window G6 indicating the energy peak time information. The pop-up window G6 may include a text that indicates the start of the energy peak time, and that prompts the use of the home appliance 2 at the off-peak time, an end time of the energy peak time and cost saving information. The cost saving information may include information on electricity cost that may be saved for each home appliance. As illustrated in FIG. 14, information indicating that, when using the washing machine, the clothes dryer and the clothes care apparatus at the off-peak time, it is possible to save 500 won in electricity cost for the washing machine, and to save 600 won in electricity cost for the dryer and the clothes care apparatus, may be provided.

Referring to FIG. 15, the mobile apparatus 3 may display a pop-up window G7 indicating the start of the off-peak time. The pop-up window G7 regarding the start of the off-peak time may be displayed in a similar way to FIG. 14. The pop-up window G7 indicating the start of the off-peak time may include a text that prompts the use of the home appliance 2 at the current time, a start time of the energy peak time and cost saving information.

Referring to FIG. 16, the mobile apparatus 3 may display a pop-up window G8 indicating a change in the energy peak time information. The energy peak time information determined by the power company may change. For example, the energy peak time information may be changed due to the occurrence of an event such as a change in an electricity rate plan and a sales promotion. The mobile apparatus 3 may obtain the energy peak time information every predetermined time period, and display a notification message indicating a change in the energy peak time information.

Figure 17:
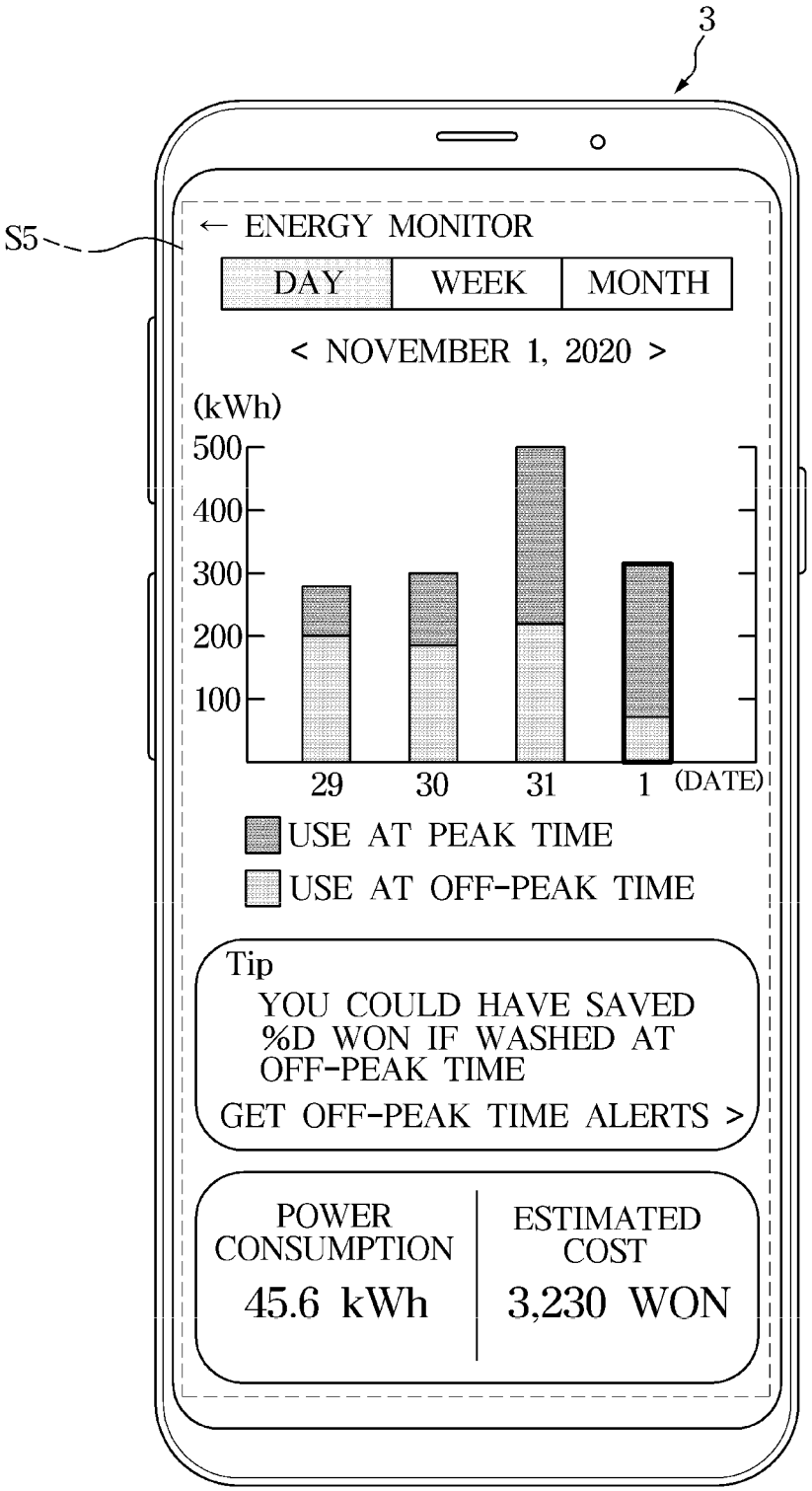
FIG. 17 is a view illustrating an example of a screen providing monitoring information on energy use.

FIG. 17 is a view illustrating an example of a screen providing monitoring information on energy use.

Referring to FIG. 17, the mobile apparatus 3 may display a fourth user interface S5 including monitoring information about the energy use. The mobile apparatus 3 may collect the user's home appliance usage history, and analyze a user's usage pattern based on the collected usage history. The monitoring information may include daily power consumption, weekly power consumption and monthly power consumption. The mobile apparatus 3 may display one of the daily power consumption, weekly power consumption and monthly power consumption based on a user input through the fourth user interface S5. Further, the daily power consumption, weekly power consumption and monthly power consumption may be displayed in the form of a graph that distinguishes the power consumption at the off-peak time. Therefore, a user can easily check the power consumption at the energy peak time and the power consumption at the off-peak time.

The mobile apparatus 3 may display information about cost that may be saved on a specific date and information about cost on a specific date. In addition, the mobile apparatus 3 may separately display an estimated cost for an amount of power consumed at the energy peak time and an estimated cost for an amount of power consumed at the off-peak time. For example, it may be displayed that the amount of power consumed at the off-peak time on Nov. 1, 2020 is 45.6 kWh, and the estimated cost is 3,230 won.

Further, monitoring information on the energy use may be provided in various forms.

As mentioned above, the home appliance system, the mobile apparatus configured to control home appliances, and the method for controlling the home appliances may guide a user to use the home appliance for treating clothes while avoiding an energy peak time. The user can save energy costs by avoiding the energy peak time.

Further, the home appliance system, the mobile apparatus configured to control home appliances, and the method for controlling the home appliances may, when a plurality of home appliances is to be used sequentially, adjust an operation time of each home appliances to allow the operation time of each home appliances to avoid an energy peak time. For saving energy cost, the operation time of the plurality of home appliances may be automatically adjusted and be guided to a user, thereby improving the user's convenience.

Further, the home appliance system, the mobile apparatus configured to control home appliances, and the method for controlling the home appliances may analyze a user's usage pattern for a plurality of home appliances, and recommend a power company suitable for the usage pattern.

Meanwhile, the disclosed embodiments may be embodied in the form of a recording medium storing instructions executable by a computer. The instructions may be stored in the form of program code and, when executed by a processor, may generate a program module to perform the operations of the disclosed embodiments. The recording medium may be embodied as a computer-readable recording medium.

Storage medium readable by machine, may be provided in the form of a non-transitory storage medium. "Non-transitory" means that the storage medium is a tangible device and does not contain a signal (e.g., electromagnetic wave), and this term includes a case in which data is semi-permanently stored in a storage medium and a case in which data is temporarily stored in a storage medium. For example, "non-transitory storage medium" may include a buffer in which data is temporarily stored.

The method according to the various disclosed embodiments may be provided by being included in a computer program product. Computer program products may be traded between sellers and buyers as commodities. Computer program products are distributed in the form of a device-readable storage medium (e.g., compact disc read only memory (CD-ROM)), or are distributed directly or online (e.g., downloaded or uploaded) between two user devices (e.g., smartphones) through an application store (e.g., Play Store™). In the case of online distribution, at least a portion of the computer program product (e.g., downloadable app) may be temporarily stored or created temporarily in a device-readable storage medium such as the manufacturer's server, the application store's server, or the relay server's memory.

While the present disclosure has been particularly described with reference to exemplary embodiments, it should be understood by those of skilled in the art that various changes in form and details may be made without departing from the spirit and scope of the present disclosure.

What is claimed is:

1. A home appliance system, comprising:

a washing machine configured to wash clothes;

a drying device configured to dry the clothes;

an external server configured to communicate with the washing machine and the drying device; and a mobile apparatus configured to control the washing machine and the drying device through the external server, wherein the mobile apparatus is configured to:

obtain energy peak time information including information about energy price according to a time of day, from the external server, display a first user interface to receive a selection for a first sequential course sequentially operating the washing machine and the drying device, determine a first operation time of the first sequential course required for performing the first sequential course, the first operation time including a first washing time of the washing machine and a first drying time of the drying device, display a second user interface to receive a selection of whether to perform the first sequential course based on the energy peak time information and the first operation time, and transmit first sequential course information including the first washing time and the first drying time, for controlling operation of the washing machine at the first washing time and operation of the drying device at the first drying time, to the external server in response to receiving the selection for performing the first sequential course.

2. The home appliance system of claim 1, wherein the second user interface includes a button provided to receive an input of a selection for performing the first sequential course while avoiding an energy peak time.

3. The home appliance system of claim 2, wherein the mobile apparatus is configured to display a third user interface to receive a selection for a second sequential course requiring a second operation time less than the first operation time, based on the energy peak time information.

4. The home appliance system of claim 2, wherein the mobile apparatus is configured to provide a third user interface to change a performance start time of the first sequential course.

5. The home appliance system of claim 2, wherein the mobile apparatus is configured to provide a third user interface to set an interval time between completion of operation of the washing machine and start of operation of the drying device, based on the energy peak time information.

6. A mobile apparatus configured to control a washing machine and a drying device through an external server, comprising:

a display;

a communication circuitry configured to communicate with the external server; and a controller configured to control the display and the communication circuitry, wherein the controller is configured to:

obtain electricity rate information including an energy peak time in which an electricity rate is higher than a reference rate, from the external server, provide a first user interface to receive a selection for a first sequential course including a first washing course performed by the washing machine and a first drying course performed by the drying device in accordance with the first washing course, on the display, determine a first operation time of the first sequential course including a first washing time required for performing the first washing course and a first drying time required for performing the first drying course, provide a second user interface to receive a selection of whether to perform the first sequential course based on the energy peak time and the first operation time, and transmit, via the communication circuitry, first sequential course information including first washing course information, including the first washing time for controlling operation of the washing machine at the first washing time, and first drying course information, including the first drying time for controlling operation of the drying device at the first drying time, to the external server in response to receiving the selection for performing the first sequential course through the second user interface.

7. The mobile apparatus of claim 6, wherein the first operation time includes an interval time between completion of operation of the washing machine and start of operation of the drying device.

8. The mobile apparatus of claim 6, wherein the controller is configured to:

provide a third user interface to receive a selection for performing a second sequential course including the first washing course and a second drying course requiring a second drying time less than the first drying time, on the display, and transmit second sequential course information including the first washing course information and second drying course information to the external server, in response to receiving the selection for performing the second sequential course through the third user interface.

9. The mobile apparatus of claim 6, wherein the controller is configured to:

provide a third user interface to receive a selection for performing a second sequential course including a second washing course requiring a second washing time less than the first washing time and the first drying course, on the display, and transmit second washing course information and the first drying course information to the external server, in response to receiving the selection for performing the second sequential course through the third user interface.

10. The mobile apparatus of claim 6, wherein the controller is configured to provide a third user interface to change a performance start time of the first sequential course.

11. A method for controlling a washing machine and a drying device using a mobile apparatus, comprising:

obtaining energy peak time information from an external server;

displaying a first user interface to receive a selection for a first sequential course sequentially operating the washing machine and the drying device by the mobile apparatus;

determining a first operation time of the first sequential course required for performing the first sequential course, the first operation time including a first washing time of the washing machine and a first drying time of the drying device, in response to the selection of the first sequential course through the first user interface;

displaying a second user interface to receive a selection of whether to perform the first sequential course based on the energy peak time information and the first operation time; and transmitting first sequential course information including the first washing time and the first drying time, for controlling operation of the washing machine at the first washing time and operation of the drying device at the first drying time, to the external server, in response to receiving the selection for performing the first sequential course through the second user interface.

12. The method of claim 11, wherein the displaying of the second user interface includes displaying a button provided to receive an input of a selection for performing the first sequential course while avoiding an energy peak time.

13. The method of claim 12, further comprising:

displaying a third user interface to receive a selection for performing a second sequential course requiring a second operation time less than the first operation time.

14. The method of claim 12, further comprising:

displaying a third user interface to change a performance start time of the first sequential course.

15. The method of claim 12, further comprising:

displaying a third user interface for setting an interval time between completion of operation of the washing machine and start of operation of the drying device, based on the energy peak time information.

* * * * *